US009371606B2

(12) United States Patent
Yamanashi

(10) Patent No.: US 9,371,606 B2
(45) Date of Patent: Jun. 21, 2016

(54) EMBROIDERY DATA GENERATOR, SEWING MACHINE, AND NON-TRANSITORY COMPUTER READABLE STORING MEDIUM

(71) Applicant: BROTHER KOGYO KABUSHIKI KAISHA, Nagoya-shi, Aichi-ken (JP)

(72) Inventor: Yoko Yamanashi, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/755,134

(22) Filed: Jun. 30, 2015

(65) Prior Publication Data

US 2016/0010252 A1 Jan. 14, 2016

(30) Foreign Application Priority Data

Jul. 10, 2014 (JP) ..... 2014-142280

(51) Int. Cl.
*D05C 5/02* (2006.01)
*D05B 19/10* (2006.01)
*D05B 19/12* (2006.01)

(52) U.S. Cl.
CPC ..... *D05B 19/10* (2013.01); *D05B 19/12* (2013.01)

(58) Field of Classification Search
CPC ..... D05B 19/02; D05B 19/04; D05B 19/06; D05B 19/08; D05B 19/10; D05B 19/12; D05C 5/00; D05C 5/02
USPC ..... 700/136–138
See application file for complete search history.

(56) References Cited

U.S. PATENT DOCUMENTS 5,559,711 A 9/1996 Futamura et al.
2012/0197430 A1* 8/2012 Maki ..... D05B 19/12 700/138
2013/0239858 A1* 9/2013 Ihira ..... D05C 5/06 112/102.5

FOREIGN PATENT DOCUMENTS

JP H04-158887 A 6/1992
JP H07-116367 A 5/1995
JP H07-136357 A 5/1995
JP 2874674 B2 3/1999

* cited by examiner

*Primary Examiner* — Nathan Durham
(74) *Attorney, Agent, or Firm* — Oliff PLC

(57) ABSTRACT

An embroidery data generator is configured to generate embroidery data and is provided with a pattern storing unit and a control device. The pattern storing unit is configured to store plural types of pattern data configured for sewing one or more sub-patterns according to a predetermined stitch pattern. The one or more sub-patterns constitutes an embroidery pattern. The control device is configured to randomly extract pattern data configured for sewing the one or more sub-patterns from the plural types of pattern data stored in the pattern storing unit and to assign extracted pattern data to the one or more sub-patterns.

19 Claims, 19 Drawing Sheets

| EMBROIDERY DATA | |
|---|---|
| LIGHT BLUE | SURFACE REGION DATA OF FIRST SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |
| GRAY | SURFACE REGION DATA OF SECOND SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |
| PURPLE | SURFACE REGION DATA OF THIRD SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |
| BLUE | OUTLINE DATA OF FIRST SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |
| BLUE | OUTLINE DATA OF SECOND SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |
| PURPLE | OUTLINE DATA OF THIRD SUB-PATTERN |
| (x1, y1)···<NEEDLE POSITION OF FIRST STITCH> | |
| (x2, y2)···<NEEDLE POSITION OF SECOND STITCH> | |
| (x3, y3)···<NEEDLE POSITION OF THIRD STITCH> | |
| ⋮ | |
| (xN, yN)···<NEEDLE POSITION OF NTH STITCH> | |

FIG. 3

| SURFACE PATTERN TABLE | | |
|---|---|---|
| PATTERN NUMBER | STITCH PATTERN TYPE | CATEGORY |
| 1 | SATIN STICH | BASIC |
| 2 | FILL STITCH | BASIC |
| 3 | CROSS STITCH | BASIC |
| 4 | RADIAL STITCH | BASIC |
| 5 | CONCENTRIC CIRCLE STITCH | BASIC |
| 6 | SPIRAL STITCH | BASIC |
| 7 | PIPING STITCH | BASIC |
| 8 | STIPPLING STITCH | BASIC |
| ⋮ | ⋮ | ⋮ |
| 11 | MOTIF STITCH(1) | FLOWER·LEAF |
| 12 | MOTIF STITCH(2) | FLOWER·LEAF |
| ⋮ | ⋮ | ⋮ |
| 21 | MOTIF STITCH(11) | CUTE |
| 22 | MOTIF STITCH(12) | CUTE |
| ⋮ | ⋮ | ⋮ |
| 31 | MOTIF STITCH(21) | POP |
| 32 | MOTIF STITCH(22) | POP |
| ⋮ | ⋮ | ⋮ |
| 41 | MOTIF STITCH(31) | PLOVER DESIGN |
| 42 | MOTIF STITCH(32) | PLOVER DESIGN |
| ⋮ | ⋮ | ⋮ |
| 51 | MOTIF STITCH(41) | SNOW |
| 52 | MOTIF STITCH(42) | SNOW |
| ⋮ | ⋮ | ⋮ |
| 81 | PROGRAMMED FILL STITCH(11) | CUTE |
| 82 | PROGRAMMED FILL STITCH(12) | CUTE |
| ⋮ | ⋮ | ⋮ |
| 91 | PROGRAMMED FILL STITCH | BASIC |
| 92 | PROGRAMMED FILL STITCH | BASIC |
| ⋮ | ⋮ | ⋮ |

FIG.5

| LINE PATTERN TABLE | | |
|---|---|---|
| PATTERN NUMBER | STITCH PATTERN TYPE | CATEGORY |
| 1 | ZIGZAG STITCH | BASIC |
| 2 | RUNNING STITCH(1) | BASIC |
| 3 | RUNNING STITCH(2) | BASIC |
| 4 | STEM STITCH | BASIC |
| 5 | E STITCH | BASIC |
| 6 | V STITCH | BASIC |
| 7 | CHAIN STITCH | BASIC |
| ⋮ | ⋮ | ⋮ |
| 11 | MOTIF STITCH(1) | FLOWER·LEAF |
| 12 | MOTIF STITCH(2) | FLOWER·LEAF |
| ⋮ | ⋮ | ⋮ |
| 21 | MOTIF STITCH(11) | CUTE |
| 22 | MOTIF STITCH(12) | CUTE |
| ⋮ | ⋮ | ⋮ |
| 31 | MOTIF STITCH(21) | POP |
| 32 | MOTIF STITCH(22) | POP |
| ⋮ | ⋮ | ⋮ |
| 41 | MOTIF STITCH(31) | PLOVER DESIGN |
| 42 | MOTIF STITCH(32) | PLOVER DESIGN |
| ⋮ | ⋮ | ⋮ |
| 51 | MOTIF STITCH(41) | SNOW |
| 52 | MOTIF STITCH(42) | SNOW |
| ⋮ | ⋮ | ⋮ |

FIG. 6

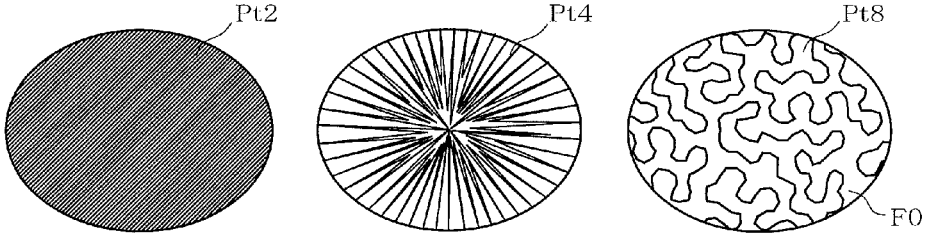
FIG. 7A
FIG. 7B
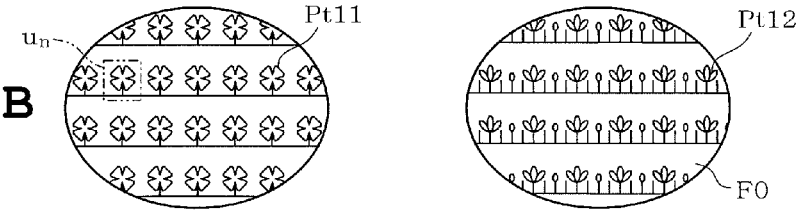
FIG. 7C
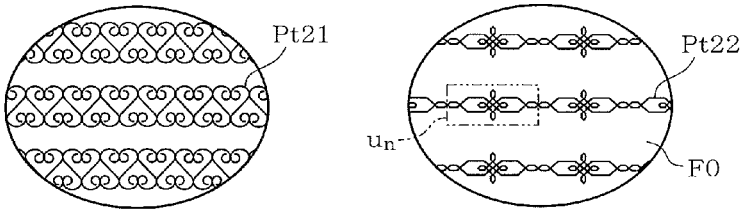
FIG. 7D
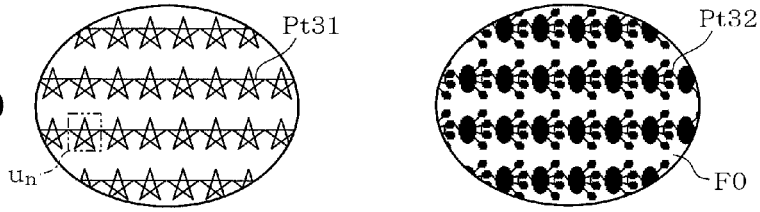
FIG. 7E
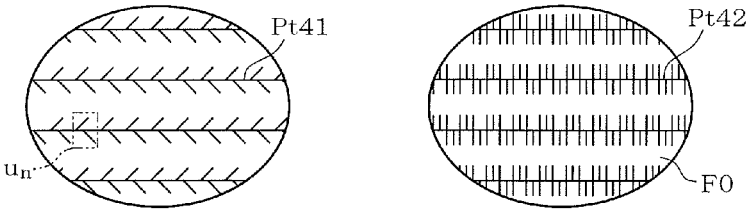
FIG. 7F
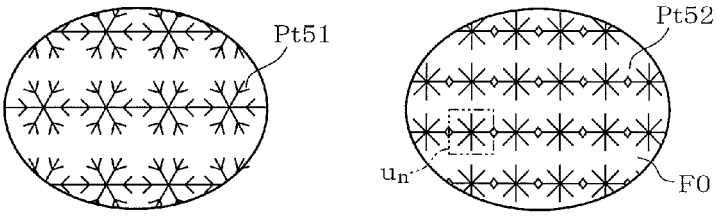

EMBROIDERY DATA GENERATOR, SEWING MACHINE, AND NON-TRANSITORY COMPUTER READABLE STORING MEDIUM

CROSS-REFERENCE TO RELATED APPLICATION

This application is based upon and claims the benefit of priority from the prior Japanese Patent Application 2014-142280, filed on, Jul. 10, 2014, the entire contents of which are incorporated herein by reference.

FIELD

The disclosure relates to an embroidery data generator that may generate embroidery data, a sewing machine, and a non-transitory computer readable storing medium.

BACKGROUND

Conventionally, an embroidery data generator is known which is capable of automatically determining the stitch patterns to be applied to multiple sub-patterns that constitute an embroidery pattern. Examples of stitch pattern include a satin stitch, a fill stitch, and a running stitch. In one example of an embroidery data generator, a circularity index is calculated using a predetermined calculation formula based on the area and the perimeter of a sub-pattern. The circularity index is a numerical value indicating whether the sub-pattern is circular or elongate. The embroidery data generator automatically determines the stitch pattern to be applied to the sub-pattern by comparing the calculated circularity index with the preset threshold value.

SUMMARY

In the above described data generator, stitch patterns to be applied to the multiple sub-patterns are determined automatically. However, the automatically determined combination of the stitch patterns of the multiple sub-patterns may not suit the taste of the user. In such case, the user was required to go through a troublesome task of manually modifying the automatically determined combination.

Aspects described herein provide an embroidery data generator, a sewing machine, and a non-transitory computer readable storing medium capable of generating embroidery data for an embroidery pattern and providing rich variety of stitch pattern combinations.

According to aspects of the disclosure, an embroidery data generator is configured to generate embroidery data and is provided with a pattern storing unit and a control device. The pattern storing unit is configured to store plural types of pattern data configured for sewing one or more sub-patterns according to a predetermined stitch pattern. The one or more sub-patterns constitutes an embroidery pattern. The control device is configured to randomly extract pattern data configured for sewing the one or more sub-patterns from the plural types of pattern data stored in the pattern storing unit and to assign extracted pattern data to the one or more sub-patterns.

According to additional aspects of the disclosure, a non-transitory computer readable storing medium stores computer readable instructions that are executed by a control device of an embroidery data generator. The embroidery data generator is provided with a pattern storing unit configured to store plural types of pattern data configured for sewing an embroidery pattern formed of one or more sub-patterns according to a predetermined stitch pattern. The computer readable instructions, when executed, cause the control device to randomly extract pattern data configured for sewing the one or more sub-patterns from the plural types pattern data stored in the pattern storing unit and assign extracted pattern data to the one or more sub-patterns.

According to additional aspects of the disclosure, a sewing machine is provided with a sewing unit, a pattern storing unit, and a control device. The sewing unit is configured to be capable of sewing a workpiece based on embroidery data. The pattern storing unit is configured to store plural types of pattern data configured for sewing one or more sub-patterns according to a predetermined stitch, pattern. The one or more sub-patterns constitutes an embroidery pattern. The control device is configured to randomly extract pattern data, configured for sewing the one or more sub-patterns, from the plural types of pattern data stored in the pattern storing unit, assign extracted pattern data to the one or more sub-patterns, and control the sewing unit to sew an embroidery pattern on the workpiece. The embroidery pattern is formed of the one or more sub-patterns which has been assigned the pattern data.

This summary is not intended to identify critical or essential features of the disclosure, but instead merely summarizes certain features and variations thereof. Other details and features will be described in the sections that follow.

BRIEF DESCRIPTION OF THE DRAWINGS

Aspects of the disclosure are illustrated by way of example, and not by limitation, in the accompanying figures in which like reference characters may indicate similar elements.

FIG. 3 illustrates one example of embroidery data.

FIG. 5 illustrates one example of a surface pattern table.

FIG. 6 illustrates one example of a line pattern table.

FIGS. 7A, 7B, 7C, 7D, 7E, and 7F illustrate examples of surface region stitch patterns registered in the surface pattern table.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments will be described with reference to the accompanying drawings.

First Embodiment

A first embodiment is described through an example of a sewing machine hereinafter referred to as a sewing machine M with reference to FIGS. 1 to 15.

Figure 1:
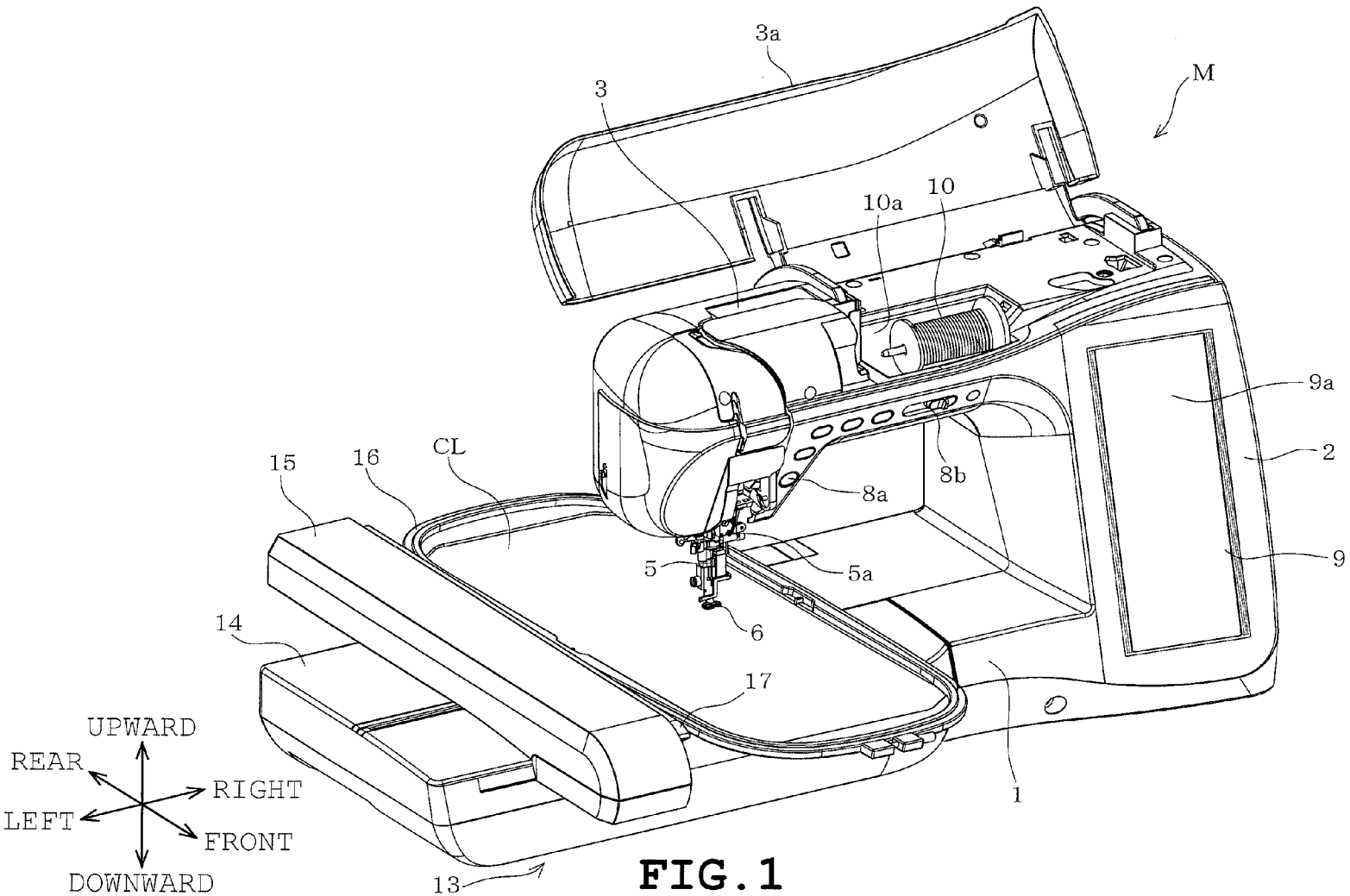
FIG. 1 pertains to a first embodiment and is a perspective view of a sewing machine.

Referring to FIG. 1, the sewing machine M is primarily configured by a bed 1, a pillar 2, and an arm 3 that are structurally integral. The pillar 2 extends upward from the right end of the laterally extending bed 1. The arm 3 extends leftward from the upper portion of the pillar 2 and contains a laterally extending main shaft not illustrated of the sewing machine. The pillar 2 contains a sewing machine motor 4 shown in FIG. 2 that drives the main shaft in rotation. Description will be given hereinafter with an assumption that one side of the sewing machine M facing the user/operator and being provided with later described switches and displays is the front side, and the direction in which the user/operator positions himself/herself to face the sewing machine M is the forward direction. The opposite side of the front side is the rear side and the direction opposite the forward direction is the rearward direction. Further, the direction in which the pillar 2 is located relative to the center of the bed 1 is assumed as the rightward direction/right side and the opposite side, is assumed as the leftward direction/left side. Further, the forward and rearward directions are also referred to as the Y direction and the leftward and rightward directions are also referred to as the X direction.

At one end of the arm 3 distal from the pillar 2, a needle bar 5*a* and a presser bar not illustrated are provided. The needle bar 5*a* has a sewing needle 5 attached to it whereas the presser bar has a presser foot 6 attached to it. Though not illustrated, the arm 3 further contains components such as a needle-bar drive mechanism, a needle-bar swing mechanism, a thread take-up drive mechanism, and a presser-bar drive mechanism. The needle-bar drive mechanism moves the needle bar 5*a* up and down through the rotation of the main shaft. The needle-bar swing mechanism swings the needle bar 5*a* in the direction orthogonal to the direction in which the fabric is fed. In the first embodiment, the needle bar 5*a* is swung in the left and right direction. The thread take-up drive mechanism drives the thread take-up in the up and down direction in synchronism with the up and down movement of the needle bar 5*a*. The presser-bar drive mechanism drives the presser bar up and down.

At the upper portion of the arm 3, an openable/closable cover 3*a* is provided for opening/closing the upper surface of the arm 3. The cover 3*a*, when opened, reveals a slot 10*a* defined in the forward mid portion of the arm 3 for storing a thread spool 10. Needle thread drawn from the thread spool 10 is engaged with a number of components such as the thread take-up that define a thread passageway and is ultimately supplied to the sewing needle 5. On the front side of the arm 3, various operation switches such as a start/stop switch 8*a* for instructing the starting and the stopping of a sewing operation is provided as well as a speed adjustment dial 8*b* for setting the sewing speed, in other words, the speed of rotation of the main shaft.

Figure 2:
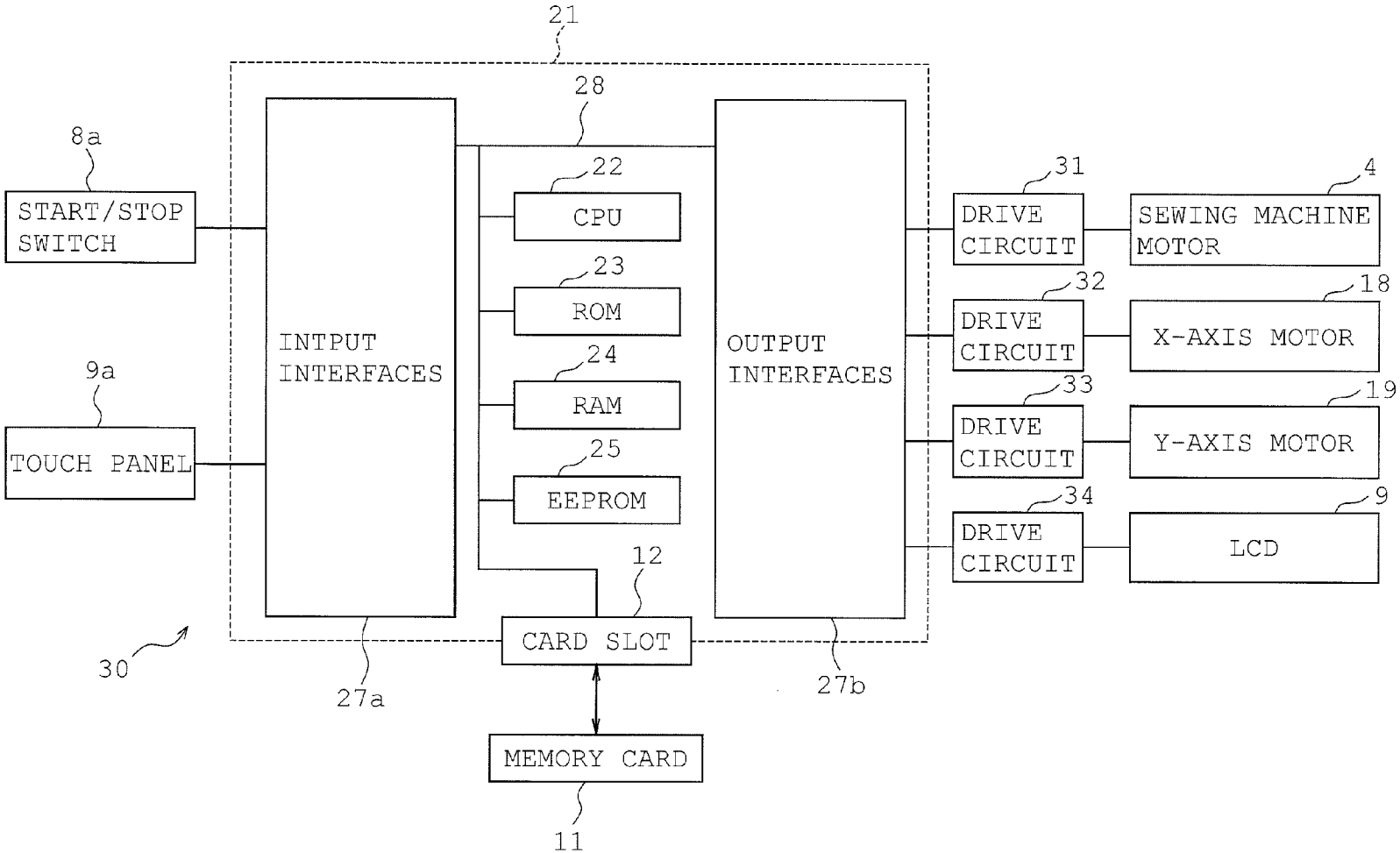
FIG. 2 is a block diagram showing an electrical configuration of the sewing machine.

On the front face of the pillar 2, a sizable and vertically elongate liquid crystal display 9 capable of displaying in full color is provided. The liquid crystal display 9 is hereinafter simply referred to as a display 9. The display 9 presents various information such as names of various functionalities to be executed in a sewing operation, selection of patterns to be sewn including embroidery patterns and utility patterns, and user interfaces such as screens for specifying the stitch patterns used in the patterns to be sewn. On the front face of the display 9, a touch panel 9*a* is provided as shown in FIG. 2 that has multiple touch keys comprising transparent electrodes. The touch keys are depressed by the user's fingers or a touch pen not illustrated for selecting embroidery patterns to be sewn, giving instructions for executing the desired function, and setting various parameters, etc. Such depression of the touch keys are hereinafter referred to as a touch operation.

On the right side surface of the pillar 2, a card slot 12 is provided for insertion of a memory card 11 only illustrated in FIG. 2 that stores data such as embroidery data for various types of embroidery patterns.

On the upper surface of the bed 1, a needle plate not illustrated is provided. Within the bed 1 below the needle plate, components such as a cloth feed mechanism, a horizontal shuttle mechanism, and a thread cutter are provided neither of which are illustrated. The cloth feed mechanism drives a feed dog up and down and back and forth. The horizontal shuttle mechanism contains a bobbin and forms stitches in cooperation with a sewing needle 5. The thread cutter mechanism cuts a needle thread and a bobbin thread.

The bed 1 allows detachable attachment of an embroidery frame transfer device 13 at its left end. The embroidery frame transfer device 13 is primarily configured by a body 14 and a movable section 15. The body 14 is substantially level with the upper surface of the bed 1 when the embroidery frame transfer device 13 is attached to the bed 1. The movable member 15 is provided on the upper surface of the body 14 so as to be movable in the left and right direction over the body 14. The embroidery frame transfer device 13 is further provided with a carriage 17, an X-direction transfer mechanism, and a Y-direction transfer mechanism that are neither illustrated. The carriage 17 is attached to the movable member 15 so as to be movable in the front and rear direction relative to the movable member 15 and allows detachable attachment of an embroidery frame 16 which holds a fabric CL to be sewn. The X-direction transfer mechanism, disposed in the body 14, drives the carriage 17 as well as the movable member 15 in the left and right direction. The Y-direction transfer mechanism, disposed in the movement member 15, drives the carriage 17 in the front and rear direction. The X- and Y-direction transfer mechanisms are driven by an X-axis motor 18 and a Y-axis motor 19, respectively which are illustrated in FIG. 2. The embroidery frame transfer device 13 moves an embroidery frame 16 attached to the carriage 17 in the left and right direction as well as in the front and rear direction by the X-direction transfer mechanism and the Y-direction transfer mechanism by driving the X-axis motor 18 and the Y-axis motor 19 based on the embroidery data of the embroidery patterns.

Next, a description will be given on a control system of the sewing machine M with reference to the block diagram provided in FIG. 2.

A controller 21 is primarily configured by a microcomputer including a CPU 22, a ROM 23, a RAM 24, an EEPROM 25, a card slot 12, an input interface 27*a*, an output interface 27*b*, and a bus that interconnects the foregoing elements. The input interface 27*a* establishes connection with components such as a start/stop switch 8*a* and a touch panel 9*a*, whereas the output interface 27*b* establishes connection with components such as a sewing machine motor 4, an X-axis motor 18, a Y-axis motor 19, the display 9 and drive circuits 31, 32, 33, and 34 that drive the foregoing components, respectively. The controller 21, the display 9, and the drive circuit 34 are examples of a display unit. Components such as the controller 21, the touch panel 9*a*, the display 9, and the drive circuit 34 constitute embroidery data generator 30.

The ROM 23 stores items such as embroidery data, an embroidery data generator program, a sewing control program, and a display control program. The embroidery data is used for sewing embroidery patterns with sewing machine M. As later described in detail, an embroidery pattern is made of one or more sub-patterns. The embroidery data generator program which makes the computer function as a processing unit for generating embroidery data. The display control program controls the display 9.

The ROM 23 stores information such as a stitch pattern table and master thread information table used when executing an embroidery data generator program. As later described in detail, the stitch pattern table includes a surface pattern table indicated in FIG. 5 and a line pattern table indicated in FIG. 6. The surface pattern table and the line pattern table contain multiple types of stitch patterns. The master thread information table contains all the information pertaining to types of threads used in embroidering such as color information.

The foregoing programs and data may be stored in an internal storage such as an EEPROM 25 or in an external storage such as a memory card 11. In case the embroidery data generator program, for example, is stored in the external storage, the controller 21 executes the program by loading it into the RAM 24.

Figure 11:
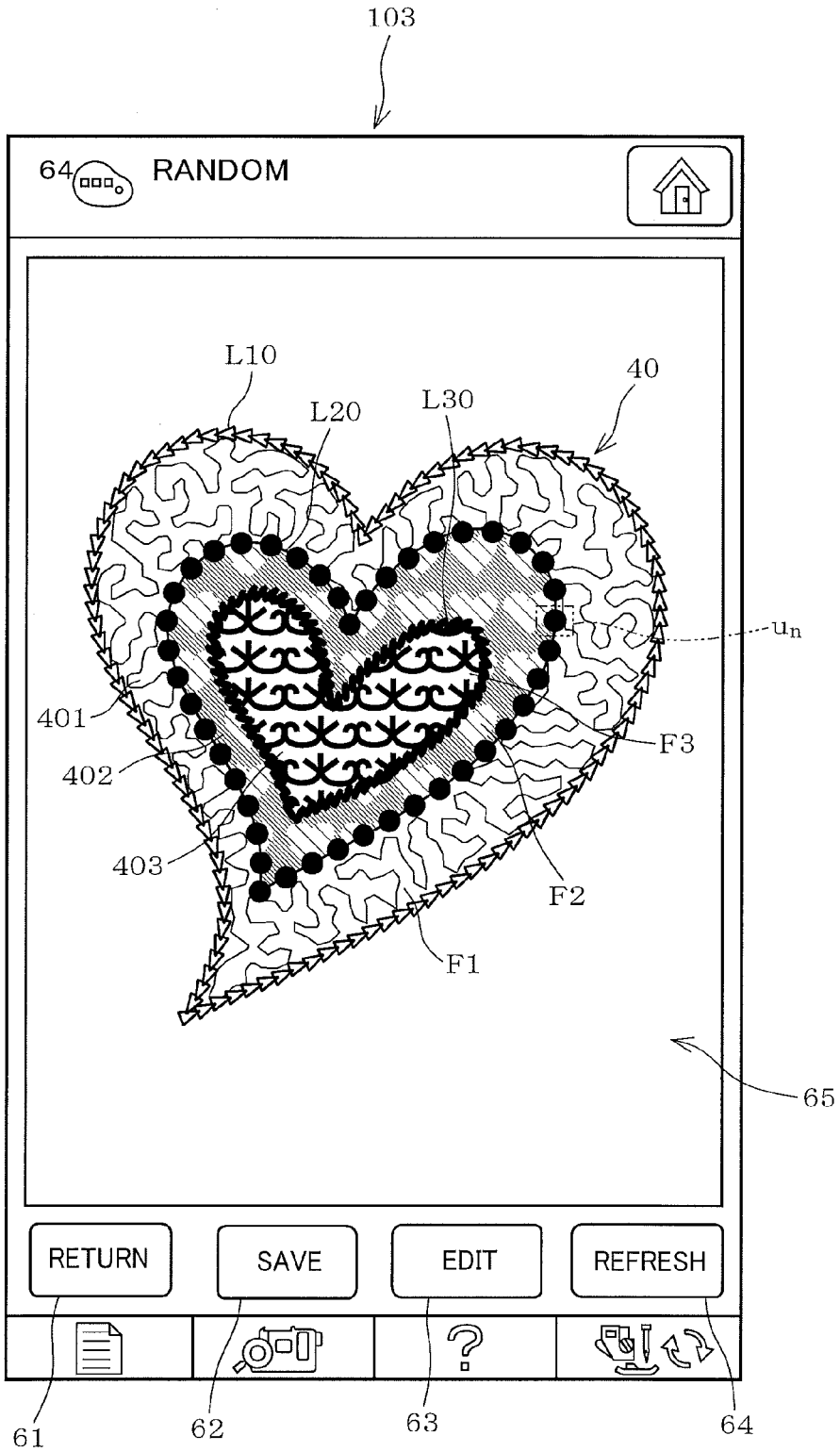
FIG. 11 illustrates an enlarge screen.

Next, an embroidery pattern will be described through an example of an embroidery pattern 40 presented as a "heart" on a screen 103 shown on display 9 as illustrated in FIG. 11. The embroidery pattern 40 is formed of k (k≥) number of sub-patterns identified as a first sub-pattern 401 to a third sub-pattern 403 (kth sub-pattern 40*k*). More specifically, embroidery pattern 40 is a pattern in which the first sub-pattern 401, the second sub-pattern 402, and the third sub-pattern 403, all of which are shaped like a heart and becoming smaller in the listed sequence, are laid out substantially in a concentric manner.

Embroidery pattern 40 is sewn with different stitching in for example each of surface regions of sub-patterns 401 to 403 and each of outlines of sub-patterns 401 to 403. The surface regions of sub-patterns 401 to 403 are regions defined as embroidery regions. In the following description, the outlines of the first sub-pattern 401, the second sub-pattern 402, and the third sub-pattern 403 are identified as an outline L10, outline L20, and outline L30, respectively. The region inside outline L10 and outside outline L20 is identified as surface region F1 of the first sub-pattern 401. The region inside outline L20 and outside outline L30 is identified as surface region F2 of the second sub-pattern 402. The region inside outline L30 is identified as surface region F3 of the third sub-pattern 403.

Examples of stitch patterns will be later described in further detail and thus, a brief description will be given on examples of stitching performed in each of the sub-patterns. In the first sub-pattern 401, a stippling stitch is used in the surface region F1 and a chain stitch is used in the outline L10. In the second sub-pattern 402, a programmed fill stitch is used in the surface region F2 and a candle wicking stitch is used in the outline L20. In the third sub-pattern 403, a motif stitch is used in the surface region F3 and a stem stitch is used in the outline L30.

Thread colors of sky blue, gray, and purple for example are assigned to surface region F1 of sub-pattern 401, surface region F2 of sub-pattern 402, and surface region F3 of sub-pattern 403, respectively. Further, thread colors of blue, blue, and purple are assigned to the outlines L10, L20, and L30, respectively.

FIG. 3 illustrates one example of embroidery data for sewing surface regions F1, F2, and F3 as well as outlines L10, L20, and L30 of sub-patterns 401, 402, and 403 of the aforementioned embroidery pattern 40 according to prescribed sequence. The embroidery data contains needle location data for the three types of stitches specified to the surface regions F1 to F3 of sub-patterns 401, 402, and 403; needle location data for the three types of stitches specified to the outlines L10, L20, and L30; and thread color data. The thread color data is data specified from the aforementioned color information for identifying the thread colors used in sewing the stitches of surface regions F1 to F3 and outlines L10 to L30.

For example, the thread color data for "sky blue" in the uppermost field in FIG. 3 represents the color of the first sewn surface region F1 of the first sub-pattern 401. That is, "sky blue", being indicated by an RGB value for example in actual implementation, represents the thread color of the stitching in the surface region F1. Needle location data indicates as (x1, y1) . . . (xN, yN) represents, in sequence, the coordinates on which the sewing needle 5 is dropped. Embroidery data for patterns sewn second and later also contain thread color data such as "gray" and "purple" representing thread colors used in sewing the stitches of the surfaces regions F2, F3 and the outlines L10 to L30 as well as needle location data indicated as (x1, y1) . . . (xN, yN). Though not described in detail, the embroidery data of the embroidery pattern 40 also contains image data not illustrated to be presented on display 9. The stitch patterns of the stitches used for sewing the surface regions F1 to F3 and the outlines L10 to L30 of the embroidery pattern 40 are presented on the display 9 in the color specified to the thread color data based on the image data.

Figure 4:
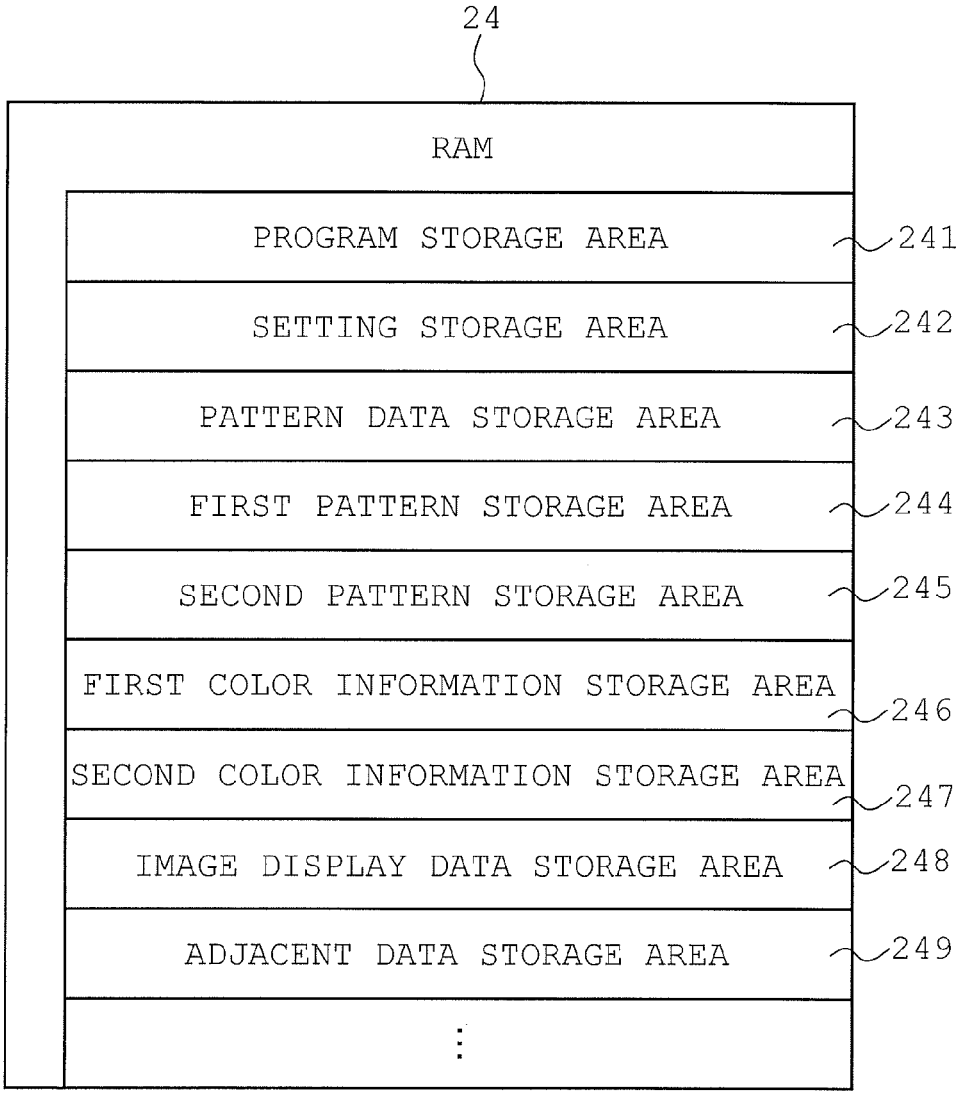
FIG. 4 is a schematic view for describing the storages areas of a RAM (Random Access Memory) provided in a sewing machine.

The RAM 24 is provided with a storage area for temporarily storing items such as the above described embroidery data, programs, various settings made through the touch panel 9*a*, and the result of calculation by the controller 21. FIG. 4 schematically illustrates an example of multiple storage areas provided in the RAM 24 such as a program storage area 241, a setting storage area 242, a pattern data storage area 243, a first pattern storage area 244, a second pattern storage area 245, a first color information storage area 246, a second color information storage area 247, image display data storage area 248, and an adjacent data storage area 249. The program storage area 241 stores various programs read from sources such as the ROM 23. The setting storage 242 stores settings and look-up tables being referred during program execution.

The pattern data storage area 243 stores the source data used when generating embroidery data. Such source data includes a total count of sub-patterns contained in an embroidery pattern and data of coordinates representing the outlines of the sub-patterns. The first pattern storage area 244 stores stitch patterns of stitches contained in the surface regions randomly extracted from the surface pattern table. The second pattern storage area 245 stores stitch patterns of outline stitches randomly extracted from the line pattern table. The first color information storage area 246 stores thread color data used in the coloring of stitches contained in a surface region. The second color information storage area 247 stores thread color data used in the coloring of outline stitches. The image display data storage area 248 stores image data of embroidery patterns to be presented on display 9. The adjacent data storage area 249 stores data pertaining to surface region stitch patterns of adjacent sub-patterns, such as sub-patterns 401 and 402 for example, contained in an embroidery pattern as later described in detail.

Next, a description will be given on the surface pattern table and the line pattern table with reference to FIGS. 5 to 8F.

As illustrated in FIG. 5, the surface pattern table stores multiple types of surface region stitch patterns. More specifically, the surface pattern table associates "pattern number" with "stitch pattern type" of the surface region and "category". Examples of stitch patterns used in the surface region include basic stitch patterns such as a satin stitch, a fill stitch, a cross stitch, a radial stitch, a concentric circle stitch, a spiral stitch, a piping stitch, and a stippling stitch. Apart from those described above, there are various types (100 types for example) of surface region stitch patterns including a motif stitch in motif of flowers, leaves, and the like. The surface region stitch patterns are classified into six categories namely, "basic", "flower•leaf", "cute", "pop", "zigzag", and "snow". FIGS. 7A to 7F illustrate examples in which some of the various types of surface region stitch patterns are classified by category. Reference symbol F0 indicates an example of an ellipse surface region defined as an embroidery region.

FIG. 7A illustrates examples of basic surface region stitch patterns belonging to the "basic" category. Among the illustrated examples, pattern Pt2 in the left side indicates a fill stitch pattern. The fill stitch pattern is formed so as to fill the surface region F0 spacelessly with stitches. Pattern Pt4 in the middle indicates a radial stitch pattern. The radial stitch pattern forms stitches extending radially from a point located substantially at the center of the surface region F0. Pattern Pt8 located in the right side indicates a stippling stitch pattern. The stippling stitch pattern forms stitches running in free and intricate curves. Apart from the examples given above, stitches in the "basic" category further include stitch patterns illustrated in FIG. 5 such as a satin stitch which is well known and a cross stitch formed by aligning stitches shaped like a letter X.

FIGS. 7B to 7F illustrate surface region stitch patterns of the motif stitch classified by category. More specifically, FIG. 7B illustrates stitch patterns Pt11 and Pt12 of the "flower•leaf" category. FIG. 7C illustrates stitch patterns Pt21 and Pt22 of the "cute" category. FIG. 7D illustrates stitch patterns Pt31 and Pt32 of the "pop" category. FIG. 7E illustrates stitch patterns Pt41 and Pt42 of the "zigzag" category. FIG. 7F illustrates stitch patterns Pt51 and Pt52 of the "snow" category.

The above described surface region stitch patterns belonging to categories other than the "basic" category are formed by regularly aligned duplicates of a unit pattern as indicated by reference symbol Un in each of FIGS. 7B to 7F. The unit patterns Un are aligned according to a preset default value. The preset default value specifies the latitudinal and longitudinal spacing between each instance of the unit pattern Un as indicated by reference symbols HS and VS in FIG. 12B, the size, and the shape as indicated by reference symbols Un, UnH, UnV etc. in FIG. 12B. Further, the surface region stitch patterns belonging to the "basic" category also have default values such as thread density, indicated by reference symbol De in FIG. 12C, specified to them. The data for stitch patterns used in the surface region is referred to as a first pattern data and is stored in storages (first pattern storing unit) such as the ROM 23 or the RAM 24.

Referring next to FIG. 5, the surface region stitch patterns in the surface pattern table include the programmed fill stitch. The programmed fill stitch spacelessly fills the surface region F0 and in doing so, the length or the orientation, etc. of stitches in predetermined locations are modified. Thus, the programmed fill stitch differs from the fill stitch described earlier in that it forms latent patterns. For example, the programmed fill stitch pattern forms multiplicity of latent patterns shaped like a small "heart" in the surface region F2 indicated in FIG. 11. Further, various types of programmed fill stitch patterns corresponding to the categorized motif are pre-stored in the surface pattern table as was the case for the motif stitch.

The line pattern table indicated in FIG. 6 stores multiple types of outline stitch patterns. More specifically, the line pattern table associates "pattern number" with "stitch pattern type" of the outline and "category". Examples of stitch patterns used in the outline include basic stitch patterns such as a "zigzag stitch", a "running stitch", a "stem stitch", an "E stitch", a "V stitch", and a "chain stitch". Apart from those described above, there are various types (100 types for example) of outline stitch patterns including a motif stitch for example representing various motifs. Running stitch (1) and running stitch (2) indicated in FIG. 6 have different stitch lengths.

The outline stitch patterns are classified into six categories namely, "basic", "flower•leaf", "cute", "pop", "zigzag", and "snow" as was the case in the surface region stitch patterns. FIGS. 8A to 8F illustrate examples in which some of the various types of outline stitch patterns are classified by category.

Figure 8A:
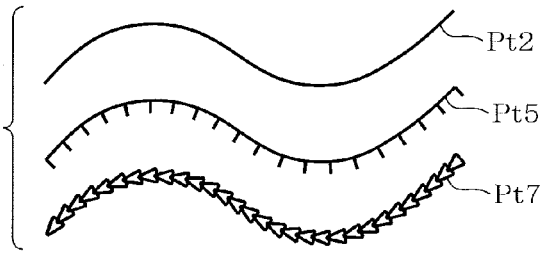
FIGS. 8A, 8B, 8C, 8D, 8E, and 8F illustrate examples of outline stitch patterns registered in the line pattern table.

FIG. 8A illustrates examples of stitch patterns belonging to the "basic" category, namely, the E stitch, patterns Pt2, Pt5, and Pt7 of the chain stitch. The stitch pattern Pt5 of the E stitch represents regularly aligned duplicates of a unit pattern shaped like a letter E. The stitch pattern Pt7 of the chains stitch represents regularly aligned duplicates of a unit pattern shaped like a triangle. The "basic" category further includes stitch patterns such as the zigzag stitch well known, the V stitch, etc.

Figure 8B:
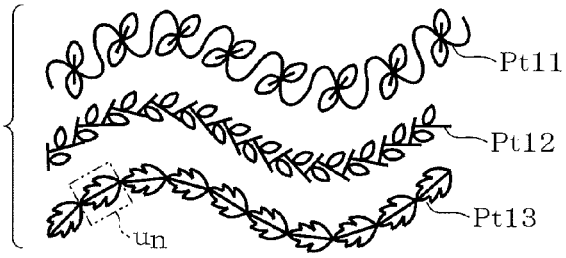
Figure 8C:
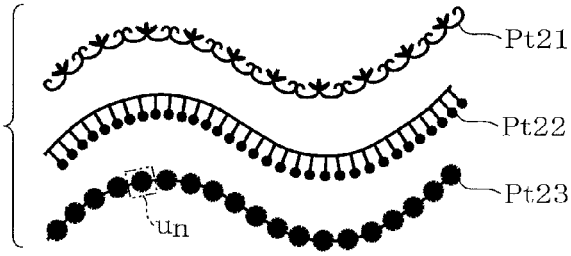
Figure 8D:
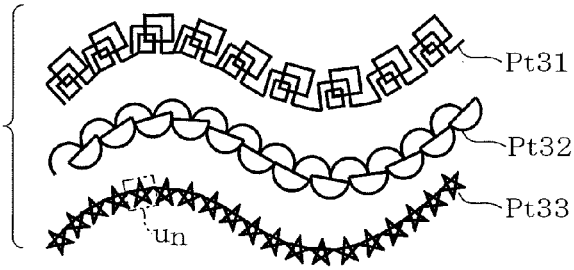
Figure 8E:
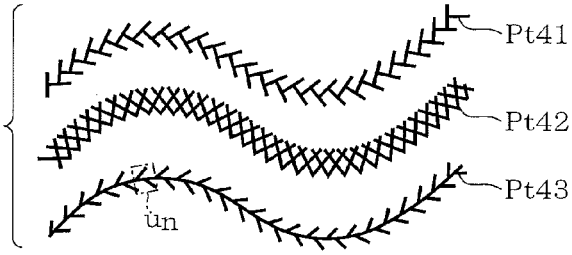
Figure 8F:
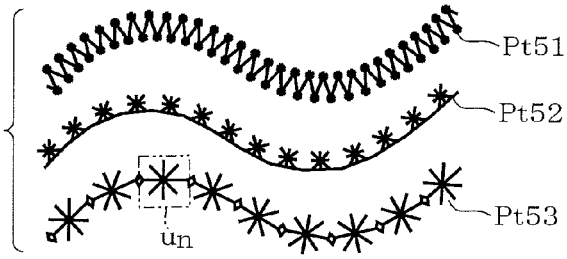

FIGS. 8B to 8F indicate the outline stitch patterns of the motif stitch classified by category. FIG. 8B indicates stitch patterns Pt11, Pt12, and Pt13 of the "flower•leaf" category. FIG. 8C indicates stitch patterns Pt21, Pt22, and Pt23 of the "cute" category. FIG. 8D indicates stitch patterns Pt31, Pt32, and Pt33 of the "pop" category. FIG. 8E indicates stitch patterns Pt41, Pt42, and Pt43 of the "plover design" category. FIG. 8F indicates stitch patterns Pt51, Pt52, and Pt53 of the "snow" category.

The outline stitch patterns belonging to categories other than the "basic" category described above are formed by regularly aligned duplicates of a unit pattern as indicated by reference symbol Un in each of FIGS. 8B to 8F. The unit patterns Un are aligned according to a preset default value. The preset default value specifies spacing between each instance of the unit pattern Un along the alignment direction as indicated by reference symbols HS in FIG. 12B, the size, and the shape as indicated by reference symbol Un in FIG. 12B. Further, the outline stitch patterns belonging to the above described "basic" category also have default values stitch pitch specified to them. The data for stitch patterns used in the outline is referred to as a second pattern data and is stored in storages (second pattern storing unit) such as the ROM 23 or the RAM 24.

Though not indicated in FIGS. 5 to 8F, the surface pattern table as well as the line pattern table contain "unsewn" pattern data. The "unsewn" pattern data indicates that the no surface region or no outline is to be sewn.

The EEPROM 25 stores information of multiple colors (color information) which is used when specifying the thread color data. The EEPROM 25 as well as the RAM 24 serve as a first color storing unit and a second color storing unit. The color information pertains, for example, to the colors of threads wound on thread spools 10 which are made available for use with the sewing machine M and is pre-defined in RGB values. In the first embodiment, a first palette table is stored in EEPROM 25. The first palette table is implemented as a first color palette 53 shown in FIG. 9. The first palette table contains RGB values of 64 colors and palette-based color numbers 1 to 64 associated with each RGB value. Apart from the first palette table, the EEPROM 25 further stores a second palette table not illustrated. The second palette table is a custom palette table and stores information of colors preselected by the user from the color information. The second palette table may be edited by the user to contain RGB values for a maximum of 300 colors and palette-based color numbers ranging from 1 to 300 associated with each of the RGB values.

Figure 9:
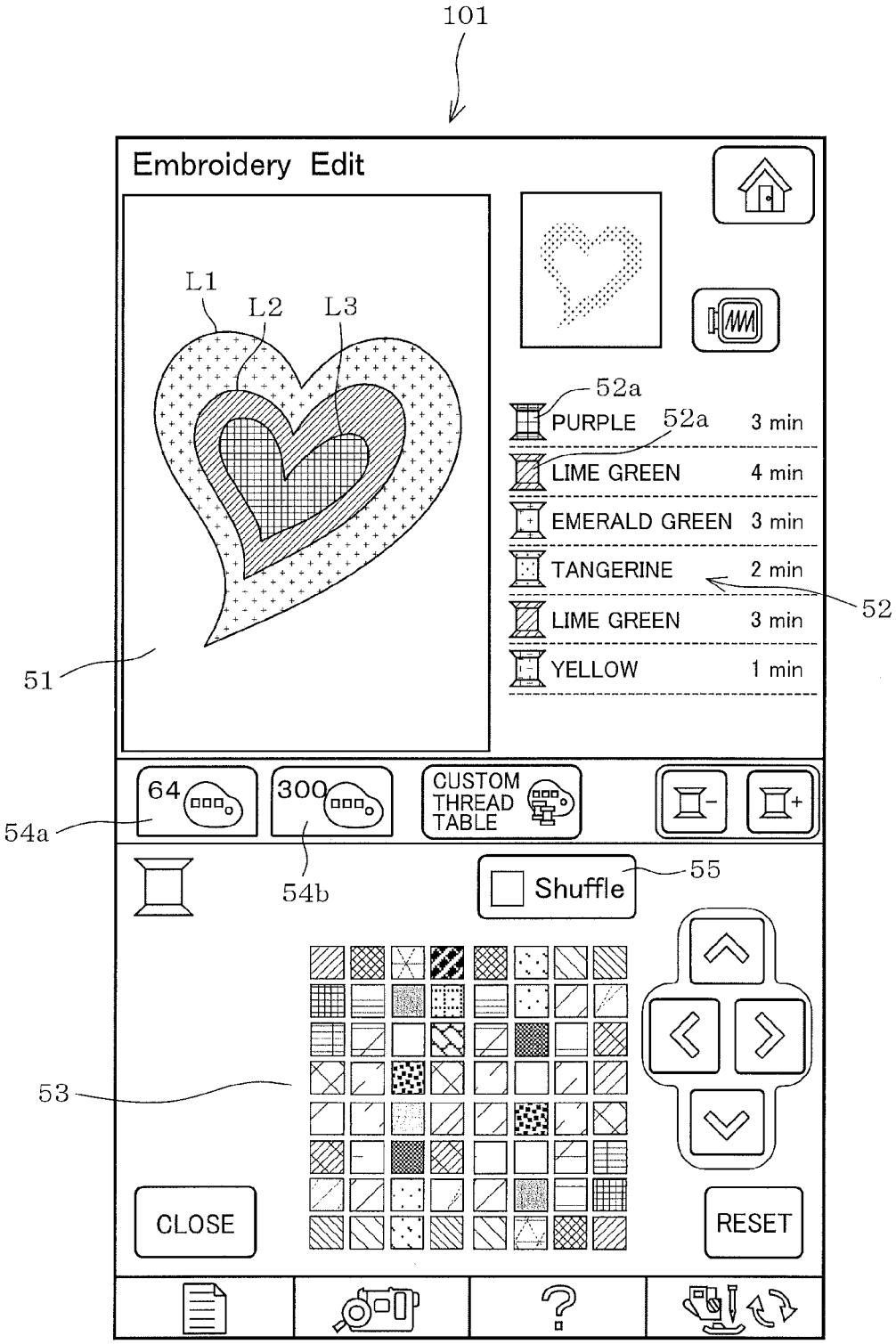
FIG. 9 illustrates first color change screen.
Figure 12A:
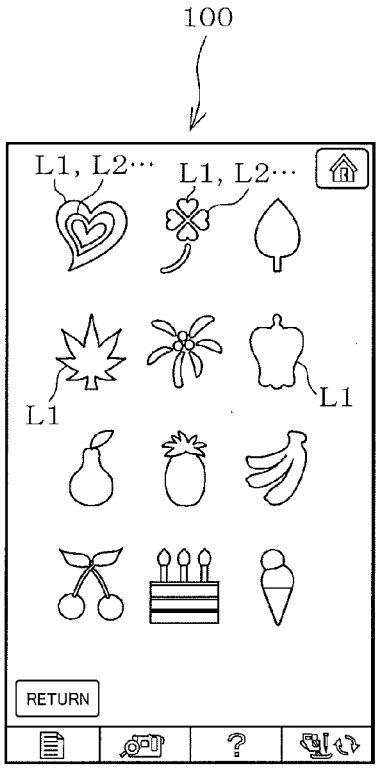
FIG. 12A illustrates a pattern selection screen
Figure 12B:
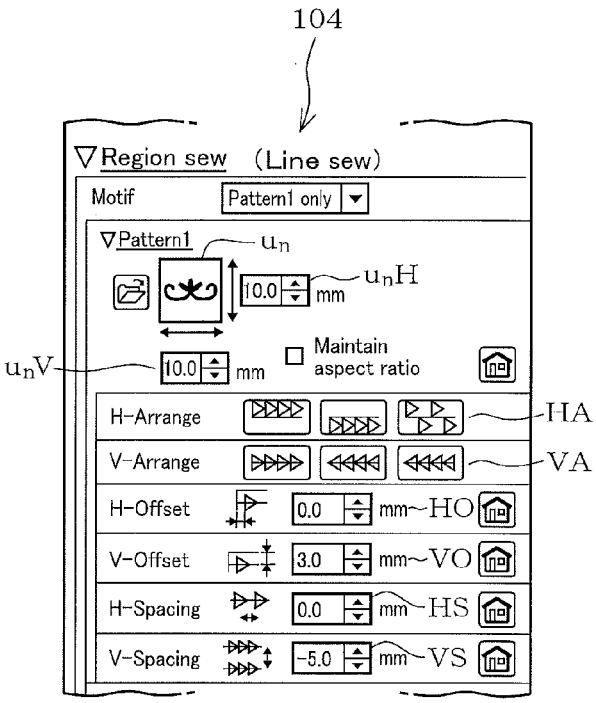
FIGS. 12B and 12C each illustrates a portion of an edit screen.
Figure 12C:
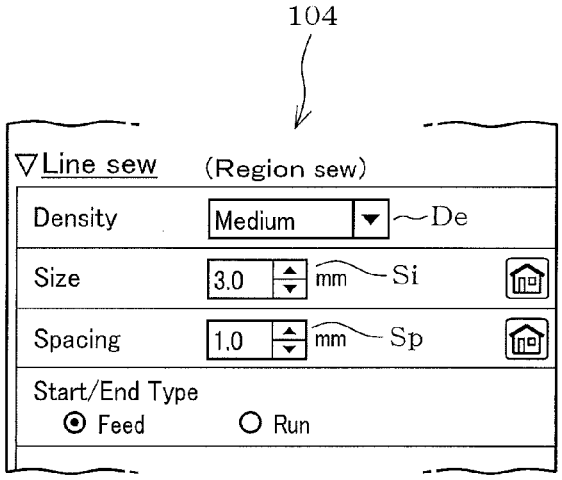

Referring next to FIGS. 9 and 12C, a description will be given on the screens presented on the display 9 when the embroidery data is being generated. FIGS. 9 to 12C illustrate screens 100 to 104 presented on the display 9. Because the display 9 is a color liquid crystal display (LCD), contents of screens 100 to 104 such as embroidery pattern images and the first color palette 53 can be displayed in various colors.

FIG. 9 illustrates one example of a first color edit screen 101 displayed when specifying the coloring of the thread color data. The first color edit screen 101 comprises a preview image area 51 and thread color data setting area 52 as well as the first color palette 53, palette selection keys 54*a* and 54*b*, and a shuffle key 55. The preview image displayed in the preview image area 51 is an image of the end result of an embroidery operation performed based on the embroidery pattern selected by the user.

Various settings pertaining to thread colors can be made through the first color edit screen 101. For example, the thread color data setting area 52 provides a list of colors, along with icons of thread spools 52*a* representing the listed colors, that are associated with the surface regions and the outlines of sub-patterns of an embroidery pattern displayed in the preview image area 51. When the icon of a given thread spool 52*a* is touched by the user, the user is allowed to specify the desired color to be assigned for each surface region or each outline of a sub-pattern from the choice of colors provided in the first color palette 53. In this example, the first color palette 53 contains 64 cells of colors arranged in 8 rows with each row containing 8 cells. Each of the 64 cells is assigned a palette-based color number of the first palette table. For example, the 8 cells in the topmost row of the first color palette 53 is assigned an RGB value of the palette-based color number 1 to 8 defined in the first palette table starting from the leftmost cell. The rest of the rows are numbered in similar manner up to number 64. Thus, the first color palette 53 contains 64 colors representing the color information contained in the first palette table.

Though not illustrated, a second color edit screen having a second color palette is provided in addition to the first color edit screen 101. The second color palette of the second color edit screen is capable of accommodating a maximum of 300 colors into 300 cells each associated with the RGB values of the color information. The second color palette is associated with the second palette table. The first color edit screen 101 and the second color edit screen are switched interchangeably by touching the pair of palette selection keys 54*a* and 54*b*. Touching the shuffle key 55 causes a transition to a stitch pattern setting screen 102 illustrated in FIG. 10.

The stitch pattern setting screen 102 is provided with a preview image area 51, a stitch pattern setting area 56, a random key 57, and a category setting portion 58. Category setting portion 58 is provided with keys 58*a*, 58*b*, 58*c*, 58*d*, 58*e*, and 58*f* corresponding to "basic", "flower•leaf", "cute", "pop", "plover design", and "snow", respectively. The stitch pattern setting area 56 displays simplified images of some of the different types of surface region stitch patterns described earlier. Though not illustrated, the stitch pattern setting area 56 is capable of displaying stitch patterns of other surface regions, outline stitch patterns, etc. by user operation to switch the content to be displayed. The user is allowed to specify the desired stitch pattern from the selection of various types of stitch patterns displayed in the stitch pattern setting area 56 by touch operation. The user is further allowed to specify the surface region and the outline of the sub-pattern to which the specified stitch pattern is to be applied by touch operation.

Random key 57 instructs random extraction and assigning of a stitch pattern for each surface region and each outline of a sub-pattern from the choice of stitch patterns provided in the surface pattern table and the line pattern table. Keys 58*a* to 58*f* for "basic" to "snow" may be selected by touching either of the keys. Touching a key from the choice of keys 58*a* to 58*f* causes the controller 21 to execute a process for randomly extracting and assigning a surface area stitch pattern and an outline stitch pattern from the choice of stitch patterns belonging to the selected category. After the assigning process is executed by the operation of either of keys 57, 58*a*, . . . , and 58*f* as described above, the screen presented on display 9 is switched to the enlarge screen 103 illustrated in FIG. 11.

The enlarge screen 103 is provided with an enlarged image area 65, a return key 61, a save key 62, an edit key 63, and a refresh key 64, etc. The enlarged image area 65 provides an enlarged view of an embroidery pattern being formed of the stitch patterns assigned by the assigning process. Touching of the refresh key 64 causes the controller 21 to assign newly extracted stitch patterns to the surface region and the outline of the targeted sub-pattern. As a result, the currently displayed embroidery pattern is replaced by a new embroidery pattern. Touching of the edit key 63 causes a transition to the later described edit screen 104. Touching of the return key 61 causes a transition to return to the stitch pattern setting screen 102. Further, touching of the save key 62 stores the embroidery data of the embroidery pattern to be sewn in the EEPROM 25 and causes a transition to return to the first color edit screen 101.

FIG. 12A illustrates an example of a pattern selection screen 100 for selecting an embroidery pattern to be subjected to the assigning process. The pattern selection screen 100 displays multiple images representing a "heart", a "clover", a "leaf", a "pepper", etc. The user is allowed to select an image, which becomes the source of the embroidery data to be generated, from the choice of images by touch operation. The embroidery patterns of "leaf" and "pepper" are each formed of a single sub-pattern having a single closed region surrounded by an outline L1. In contrast, the embroidery patterns of "heart" and "clover" are each formed of multiple sub-patterns having multiple closed region surrounded by outlines L1, L2, . . . . The coordinate data representing the outline of the sub-pattern is stored in the ROM 23 along with the thread color data. The thread color data identifies the colors of the surface regions and the outlines preset for each of the sub-patterns. The coordinate data of the outlines is configured by the coordinate data of the location of points falling on the outlines of the sub-patterns.

Further, FIGS. 12B and 12C partially illustrate examples of an edit screen 104 configured to edit parameters pertaining to the stitch patterns assigned by the assigning process. As illustrated in FIG. 12B, the edit screen 104 is provided with multiple set keys, namely set key UnH, UnV, HA, VA, HO, VO, HS, and VS. The set keys UNH, . . . VS are configured to edit the parameters that determine the sizes and the shapes of the stitch patterns. In the first embodiment, the terms "longitudinal" and "lateral" used in describing parameters and stitch patterns correspond to the directions of the "y axis" and the "x axis" of the coordinate system defining the embroidery data. Further, the unit patterns Un forming the surface region stitch patterns and the outline stitch patterns are hereinafter referred to as surface region unit patterns Un and outline unit patterns Un.

Set keys UnH and UnV at the upper portion of the edit screen 104 are configured to set the parameters for the lateral size and the longitudinal size of the surface region unit pattern Un and the outline unit pattern Un. A group of set keys HA and VA below the set keys UnH and UnV are configured to align the position and the orientation of the surface region unit pattern Un and the outline unit pattern Un as desired. Set keys HO and VO are configured to set the offset amount (default values in the lateral direction and the longitudinal direction) from the outline of the surface region stitch pattern. Set keys HS and VS are configured to set the lateral spacing and longitudinal spacing of the surface region unit pattern Un. The set key HS may be configured to be capable of setting the spacing in the direction of alignment of the outline unit pattern Un by touch operation. The display 9, the touch panel 9*a*, and the controller 21 serving as a display controller unit serve as a first edit unit and a second edit unit configured to edit various parameters for the surface region stitch pattern and the outline stitch pattern. The first edit unit and the second edit unit may be configured to edit parameters for determining at least either of the size or the shape of a stitch pattern.

The edit screen 104 is further provided with a set key De as illustrated in FIG. 12C. The set key De is used for setting the thread density of the surface region unit pattern Un and the outline unit pattern Un. By touching the set key De, it is possible to change the thread density setting for a pattern Pt2 of fill stitch illustrated in FIG. 7A for example. By touching the set key De, it is further possible to change the thread density setting for a unit pattern Un of the candle wicking stitch illustrated in FIG. 8C for example. By touching the set keys Si or Sp in the edit screen 104 illustrated in FIG. 12C, it is possible to set the size of the unit pattern Un and the spacing between the unit patterns Un of the candle wicking stitch for example.

As later described in detail when explaining the operation of the first embodiment, the controller 21 is configured to generate a random number by using a program function which takes the maximum pattern number in the surface pattern table, i.e. the total number of types of the surface region stitch patterns as a parameter. The controller 21 searches the pattern number that matches the generated random number and extracts the stitch pattern having the matching pattern number. The controller 21 assigns the extracted stitch patterns to each sub-pattern. The controller 21 serves as an extracting unit and an assigning unit of the first pattern data used for sewing the surface regions of sub-patterns. Similarly, the controller 21 is configured to generate a random number by using a program function which takes the maximum pattern number in the line pattern table as a parameter. The controller 21 searches the pattern number that matches the generated random number and extracts the stitch pattern having the matching pattern number. The controller 21 allocates the extracted stitch pattern to each sub-pattern. The controller 21 serves as an extracting unit and an allocating unit of the second pattern data used for sewing the outlines of sub-patterns.

Figure 13:
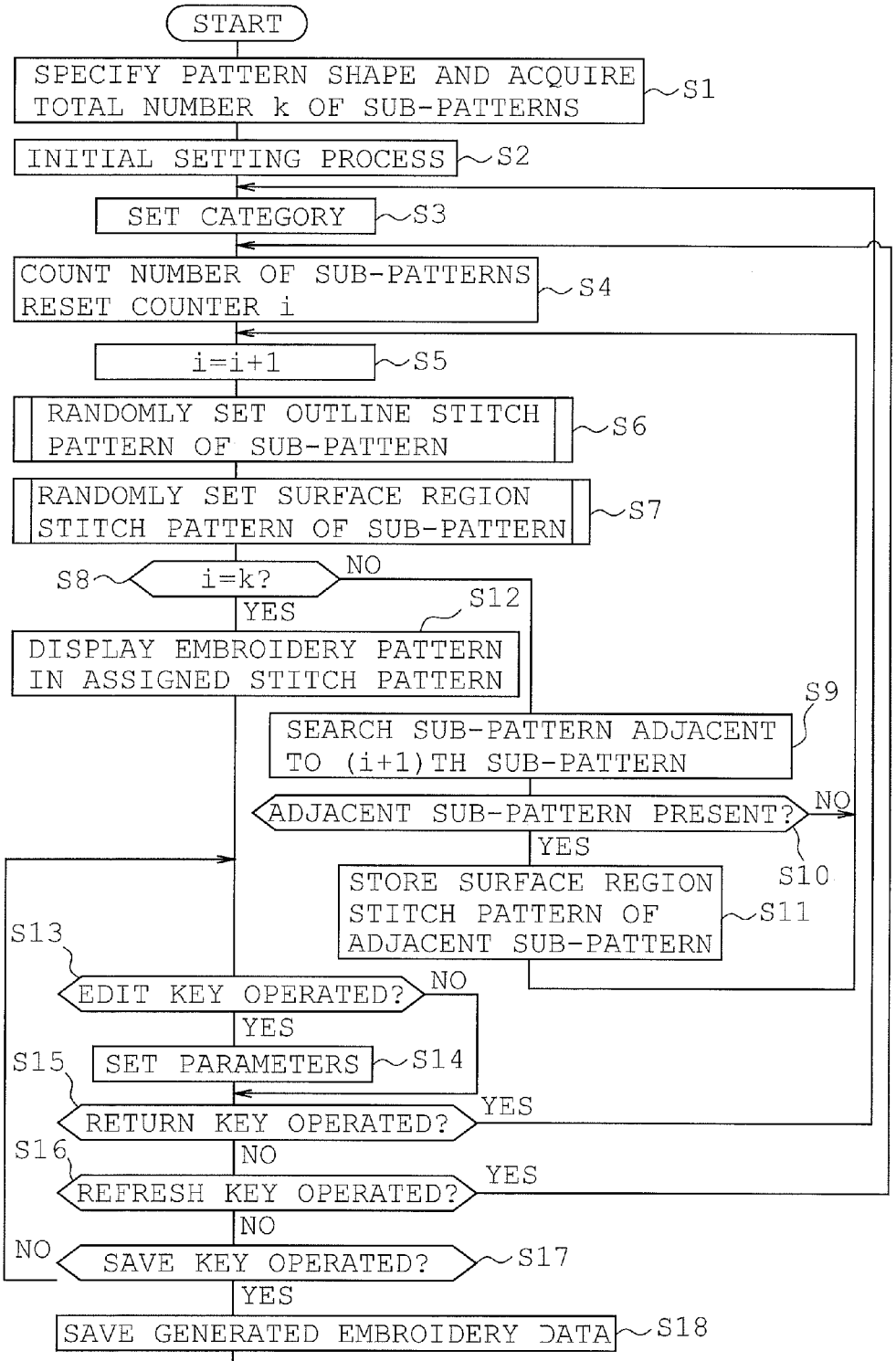
FIG. 13 is a flowchart indicating the entire process flow of an embroidery data generator program.
Figure 14:
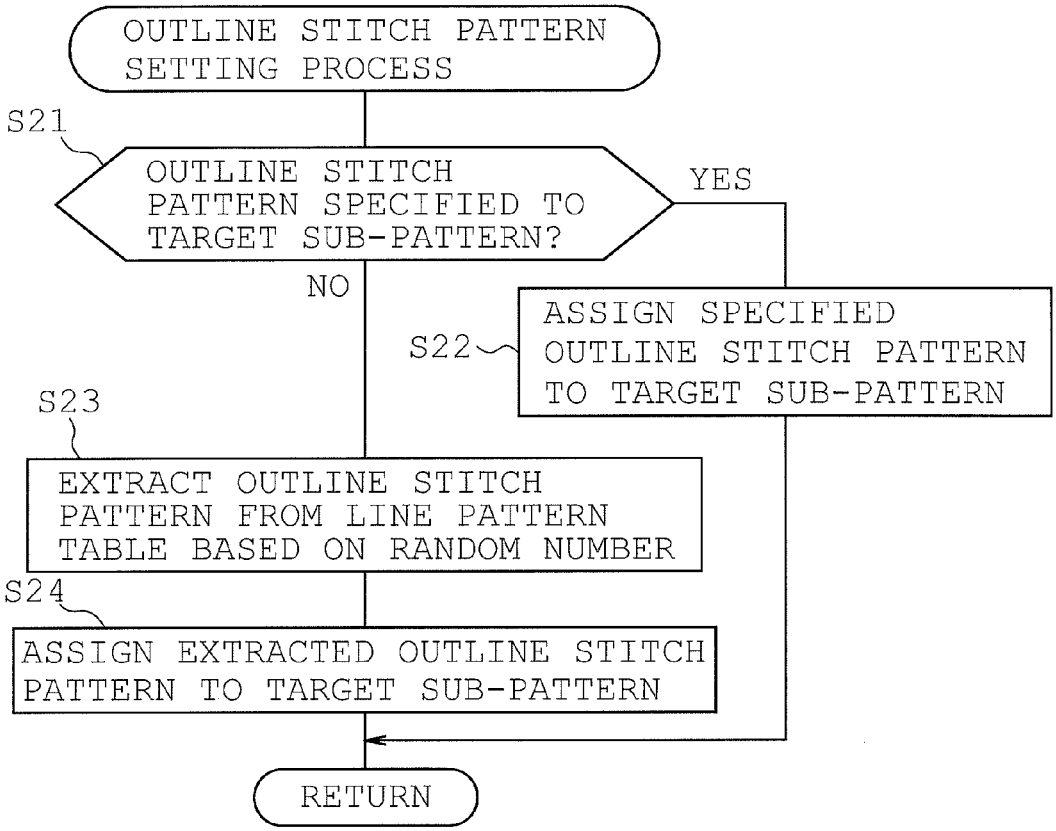
FIG. 14 is a flowchart of an outline stitch pattern setting process.
Figure 15:
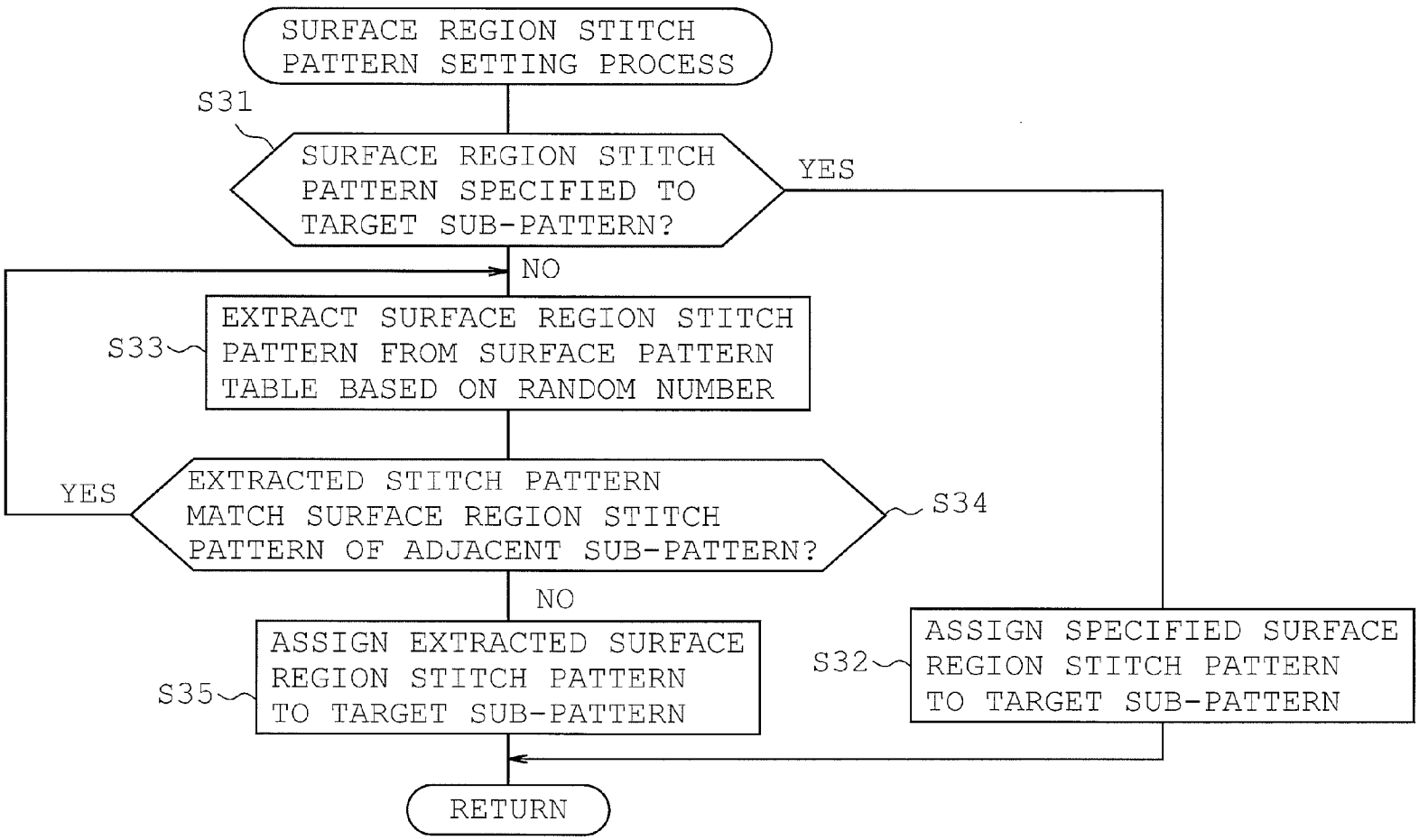
FIG. 15 is a flowchart of a surface region stitch pattern setting process.

Next, a description will be given on the operation of the embroidery data generator program with reference to FIGS. 13, 14, and 15. FIGS. 13 to 15 are flowcharts indicating the flow of processes executed by the controller 21 based on the embroidery data generator program.

First, the user is to invoke the pattern selection screen 100 illustrated in FIG. 12A by touching the touch panel 9*a*. Then, the user is to select an embroidery pattern he/she wishes to sew in the pattern selection screen 100. In this example, it is supposed that the user has selected an image of a "heart", which is the source of the embroidery pattern 40, in the pattern selection screen 100. The controller 21 responsively acquires the total number k of sub-patterns constituting the embroidery pattern corresponding to the image of the "heart" and the coordinate data for outlines L1, L2, and L3 of the sub-patterns by reading out the information from the ROM 23 and further stores the information in a pattern data storage area 243 (Step S1 in FIG. 13). In this example, the total number k of sub-patterns is three, and the sub-patterns come in different sizes of small, medium, and large. The controller 21 further makes a screen transition from the pattern selection screen 100 to the first color edit screen 101 illustrated in FIG. 9 which displays the image of the "heart". Then, in the first color edit screen 101, coloring of the "heart", i.e. embroidery pattern, is carried out (step S2).

Figure 10:
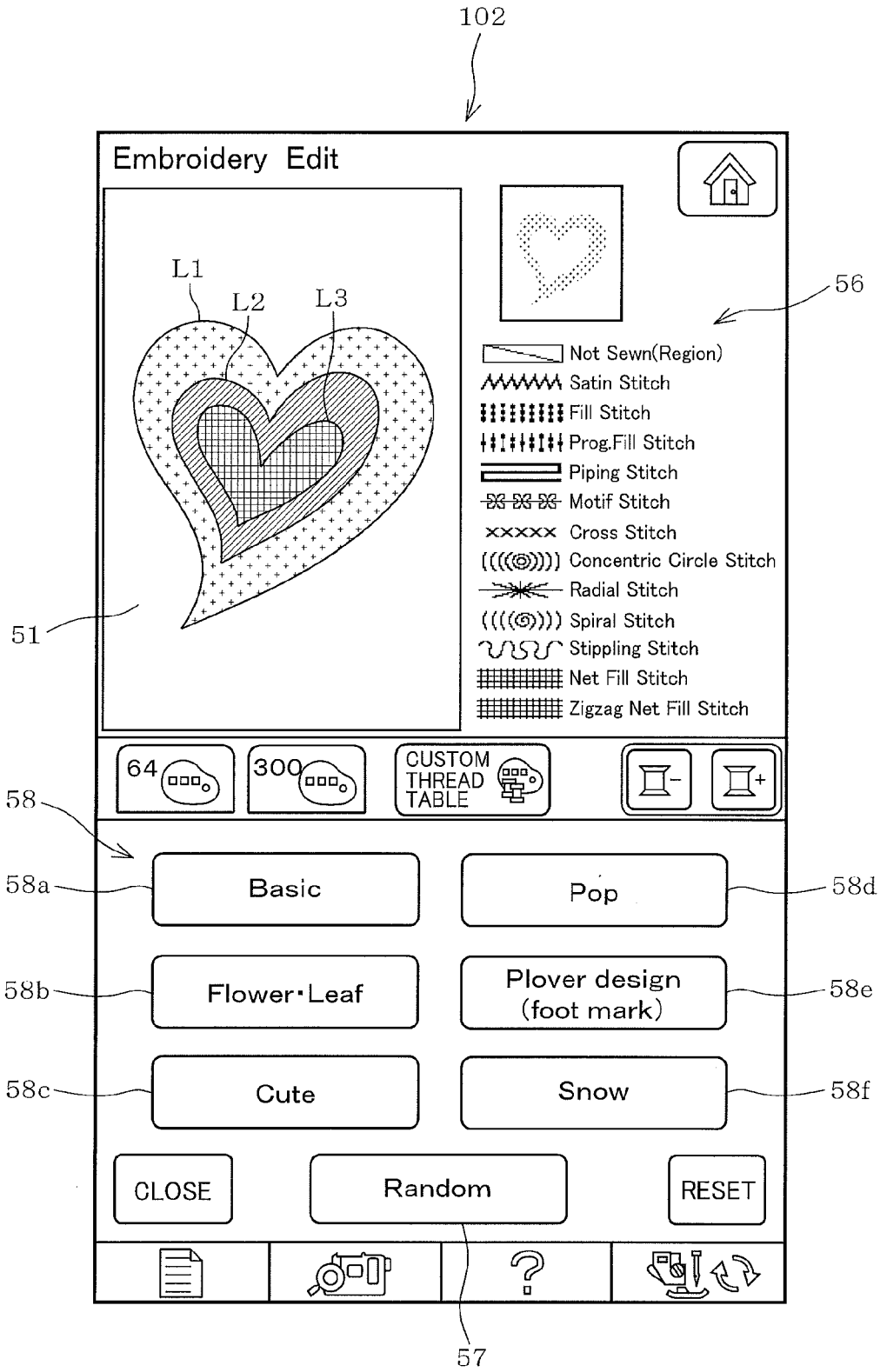
FIG. 10 illustrates a stitch pattern setting screen.

More specifically, suppose that the user wishes to modify some of the colors assigned to the surface regions and the outlines of the sub-patterns of the embroidery pattern displayed in the preview image area 51 of the first color edit screen 101. In such case, the thread color data corresponding to the thread spool 52*a* displayed in the thread color setting area 52 is specified from the first color palette 53 or the second color palette. The second color palette (second color edit screen) may be invoked by touching the palette selection key 54*b* of the first color edit screen 101. Then, by touching the shuffle key 55, a transition is made from the first color edit screen 101 or the second color edit screen to the stitch pattern setting screen 102 as illustrated in FIG. 10.

In the stitch pattern setting screen 102, the user is allowed to specify the stitch patterns to be assigned to the sub-patterns of the embroidery pattern displayed in the stitch pattern setting screen 102 by touching the desired stitch patterns. More specifically, the user is to specify the desired stitch pattern from various types of stitch patterns displayed in the stitch pattern setting area 56. The user is to further specify the sub-pattern (surface region or the outline) to which the specified stitch pattern is to be applied. The controller 21 terminates the process (not illustrated) when determining that the surface region stitch pattern and the outline stitch pattern have been specified for every sub-pattern at step S2.

Then, the category is specified by touching the "random" key 57 or either of the keys 58*a* to 58*f* corresponding to the "basic" to the "snow" category in the stitch pattern setting screen 102 (step S3). Then, the controller 21 initializes counter i for counting the number of sub-patterns by resetting the count to 0 (zero) (step S4). After incrementing the counter i by 1 (step S5), the process proceeds to steps for setting the outline stitch patterns and surface region stitch patterns for each of the sub-patterns starting from the first sub-pattern (steps S6 and S7).

In the outline stitch pattern setting process (step S6), the outermost sub-pattern is set as the first sub-pattern when a sub-pattern further contains sub-pattern(s) within itself as was the case for the "heart" image. The controller 21 automatically assigns a stitch pattern to the outline L1 of the outermost first sub-pattern of the selected embroidery pattern based on the coordinate data of the selected embroidery pattern. More specifically, the controller 21 determines whether or not a stitch pattern has been specified by the user in step S2 for the outline L1 as indicated in FIG. 14 (step S21). In case a stitch pattern has been specified by the user for the outline L1, the specified stitch pattern is assigned by the controller 21 (step S22).

In contrast, in case a stitch pattern has not been specified by the user in step S2 (Step S21: NO), the controller 21 refers the line pattern table and generates a random number for example within the range of the pattern numbers (Step S23). In this example, the pattern numbers ranges from 1 to 100, meaning that there are a total of 100 types of stitch patterns. Suppose that the "random" key 57 was operated in steps S3. In such case, the controller 21 generates a random number ranging from 1 to 100 and searches pattern numbers 1 to 100 in the line pattern table to find a pattern number that matches the generated random number and extracts (identifies) the stitch pattern associated with the matching pattern number.

In contrast, suppose that either of the keys 58*a* to 58*f* corresponding to "basic" to "snow" was operated in step S3. In such case, the stitch pattern, associated with the pattern number that matches the generated random number based on the line pattern table, is extracted provided that the stitch pattern belongs to the category specified at step S3. For example, in case the "basic" category is specified by operating the key 58*a* and the generated random number is "7", the chain stitch associated with the pattern number 7 (see FIG. 6) is extracted. In case the "basic" category is specified by operating the key 58*a* and the generated random number is "11", the controller 21 proceeds to acquire another random number without extracting the motif stitch associated with the pattern number 11. As described above, when either of the categories are specified by the user, the controller 21 is configured to repeat the extraction process of the stitch pattern until a pattern number belonging to the selected category and matching the acquired random number is found. Random extraction of a stitch pattern belonging to the specified category is carried out in the above described manner. Alternatively, a random number may be generated within the range of the total number of stitch patterns belonging to the specified category (for example, from the range of 1 to 10 when the specified category is "basic") and the stitch pattern having a pattern number matching the generated random number may be extracted.

The outline stitch pattern randomly extracted in the above described manner is assigned to the first sub-pattern (step S24). The controller 21 is configured to generate the needle position data of the outline of the first sub-pattern based on the data containing the default values pertaining to the assigned stitch pattern and the coordinate data of the original outline L1. For example, when the chain stick is assigned to the first sub-pattern 401 as illustrated in FIG. 11, a triangular unit pattern is aligned along the outline L1 at a predetermined pitch and the needle position points are plotted to each of the vertexes of the triangle. As a result, a needle position data is generated which instructs sewing of an outline L10 with a chain stitch instead of the outline L1 originally designed to be sewn with a straight stitch. The controller 21 generates the embroidery data of the outline L10 of the first sub-pattern by adding the thread color data specified at step S2 to the generated needle position data. The controller 21 stores the embroidery data of the outline L10 of the first sub-pattern to the second pattern storage area 245 of the RAM 24. Then, the process flow returns to step S7 indicated in FIG. 13.

In the stitch pattern setting process for surface regions carried out in step S7, the controller 21 determines whether or not a stitch pattern has been specified by the user for the surface region F1 of the first sub-pattern (step S31 of FIG. 15) as was the case in step S6. The controller 21, when determining that the stitch pattern of the surface region F1 has been specified by the user, assigns the specified stitch pattern (step S32).

In contrast, when the controller 21 determines that the stitch pattern of the surface region F1 has not been specified by the user (step S31: NO), the controller 21 generates a random number for example within the range of the total number of types of stitch patterns spanning from 1 to 100 (step S33) in the surface pattern table. Suppose that the "random" key 57 was operated in steps S3. In such case, the controller 21 searches pattern numbers in the surface pattern table to find a pattern number that matches the generated random number and extracts the stitch pattern associated with the matching pattern number. In contrast, when the "basic" category is specified for example at step S3 by operating the key 58*a* and the generated random number is "8", the stippling stitch associated with the pattern number 8 (see FIG. 5) is extracted by controller 21. When either of the categories are specified by the user by operating touch keys 58*a* to 58*f*, the controller 21 is configured to repeat the extraction process of the stitch pattern until a pattern number belonging to the selected category and matching the acquired random number is found. At step S34, a determination is made as to whether or not the randomly extracted stitch pattern of the surface region is identical to any other adjacent surface regions. Since no stitch pattern is assigned to any other surface region at this point time (step S34: NO), the determination step will be later described in detail.

The surface region stitch pattern randomly extracted by the controller 21 in the above described manner is assigned to the first sub-pattern (see step S35). The controller 21 is configured to generate the needle position data of the surface region F1 within the outline L1 based on the data containing the default values pertaining to the assigned stitch pattern and the coordinate data of the original outline L1. For example, when the stippling stitch is assigned to the first sub-pattern 401 as illustrated in FIG. 11, a needle position data is generated which contains needle position points that form stitches drawing free curves curving intricately within the surface region F1. The controller 21 generates the embroidery data of the surface region F1 of the first sub-pattern by adding the thread color data specified at step S2 to the generated needle position data. The controller 21 stores the embroidery data of the surface region F1 of the first sub-pattern to the first pattern storage area 244 of the RAM 24. Then, the process flow returns to step S8 indicated in FIG. 13.

After generating embroidery data for the first sub-pattern (step S8: NO) by the above described process, the controller 21 searches for the presence of sub-pattern(s) adjacent to a second sub-pattern (i+1th sub-pattern) which is generated next in sequence (step S9). The search is conducted based on the coordinate data of an outline L2 of the second sub-pattern and the coordinate data of the outlines of other sub-patterns. The controller 21, when having determined that there are no adjacent sub-patterns (step S10: NO), returns the process flow back to step S5. In contrast, when having determined the presence of sub-pattern(s) adjacent to the second sub-pattern (step S10: YES), the controller 21 stores the pattern number (s) of the surface region stitch pattern(s) of the adjacent sub-pattern(s) to the adjacent data storage area 249 (step S11) and returns the process flow back to step S5. In the example of embroidery pattern 40, both the first sub-pattern 401 and the third sub-pattern 403 are disposed adjacent to the second sub-pattern 402. However, since only the stitch pattern of the first sub-pattern 401 is identified at this point in time, the controller 21 stores only the pattern number 8 corresponding to the stippling stitch for example to the adjacent data storage area 249.

The controller 21 thereafter increments the counter i of the sub-pattern by 1 (i=i+1) in step S5. The controller 21 executes the stitch pattern setting process of step S6 for the second sub-pattern in order to assign the randomly extracted outline stitch pattern to the second sub-pattern. The controller 21 is configured to generate the needle position data of the outline of the second sub-pattern based on the data containing the default values pertaining to the assigned stitch pattern and the coordinate data of the original outline L2. In the example illustrated in FIG. 11, the controller 21 generates needle position data for the second sub-pattern 402 containing needle position points for sewing an outline L20 sewn with a candle wicking stitch instead of the outline L2 originally designed to be sewn with a straight stitch. The controller 21 generates the embroidery data of the outline L20 of the second sub-pattern by adding the thread color data to the generated needle position data. Then, the controller 21 stores the generated embroidery data of the outline L20 of the second sub-pattern to the second pattern storage area 245.

Further, the stitch pattern setting process is executed for the second sub-pattern at step S7 to randomly extract a stitch pattern different from the stitch pattern of the first sub-pattern. More specifically, suppose that the user has not specified a stitch pattern to be applied to the surface region F2 of the second sub-pattern 402 illustrated in FIG. 11 (step S31: NO in FIG. 15). In such case, the controller 21 extracts the stitch pattern associated with the pattern number that matches the random number generated as described earlier (step S33). Then, the controller 21 refers the pattern number stored in the adjacent data storage area 249 to determine whether or not the stitch pattern (stippling stitch) associated with the referred pattern number matches the extracted stitch pattern of the surface region F2 (step S34). The controller 21, when having determined that the two patterns match (step S34: YES), repeats step S33 to extract a new stitch pattern. As a result, a stitch pattern different from the first sub-pattern 401 is assigned to the second sub-pattern 402 (step S34: NO, S35). Thus, the controller 21 generates the needle position data for forming a programmed fill stitch (refer surface region F2 of FIG. 11) within the outline L2 of the second sub-pattern 402 based on the data containing the default values pertaining to the assigned stitch pattern and the coordinate data of the original outline L2. The controller 21 generates the embroidery data of the surface region F2 of the second sub-pattern by adding the thread color data to the generated needle position data. The controller 21 stores the generated embroidery data of the surface region F2 of the second sub-pattern to the first pattern storage area 244. Then, the process flow returns to step S8.

After generating embroidery data for the second sub-pattern, the controller 21 searches for the presence of sub-pattern (s) adjacent to a third sub-pattern which is generated next in sequence (step S8: YES, step S9). The controller 21, when having determined the presence of adjacent sub-pattern(s), stores the pattern number(s) of the surface region stitch pattern(s) to the adjacent data storage area 249 (step S10: YES, step S11). The controller 21 executes stitch pattern setting process for the outline and the surface region of the third sub-pattern (step S5) and generates embroidery data of the third sub-pattern (steps S6 and S7). The controller 21, when having determined that the value of counter i is equal to the number k of the sub-patterns (step S8: YES), proceeds to step S12.

The controller 21 displays the embroidery pattern to the enlarge screen 103 with the assigned stitch patterns applied to each of the sub-patterns (step S12). In the displayed embroidery pattern, the adjacently disposed sub-patterns having been subjected to the above described stitch pattern setting processes have different surface region stitch patterns (note the difference in the stitch patterns of the surface regions indicated by reference symbols F1, F2, and F3 in FIG. 11).

When the edit key 63 is touched in the enlarge screen 103 (step S13: YES), a transition is made to the edit screen 104. In the edit screen 104, various parameters pertaining to the stitch patterns may be edited (step S14) by operating the set keys UnH, UnV, . . . , VS. The controller 21, upon receiving inputs made by user operation, updates the coordinates of the needle position data provided in the embroidery data based on the edited parameters. It is thus, possible to obtain an edited version of the embroidery data which reflects the modifications made to the embroidery pattern such as the size and the shape of the surface region stitch pattern, the size and the shape of the outline stitch pattern, etc. When the return key (not illustrated) of the edit screen 104 is touched, a transition is made back to the enlarge screen 103 and the edited embroidery pattern is displayed in the enlarged image area 65.

The controller 21 is further capable of storing the generated embroidery data to the EEPROM 25 (step S18) by touching the save key 62 (step S17: YES) without editing the embroidery pattern (step S13: NO). As a result, a transition is made to the first color edit screen 101 or a menu screen not illustrated (END). When a transition is made to the first color edit screen 101, the preview image area 51 of the first color edit screen 101 displays the embroidery pattern which was displayed in the enlarge image area 65 of the enlarge screen 103.

Because the embroidery data contains the needle position data of the outline and surface region of each and every sub-pattern, the sewing sequence is automatically determined when the assigning process has been completed for all of the sub-patterns. Taking the example of embroidery pattern 40, the controller 21 sews the surface regions of the first sub-pattern 401, the second sub-pattern 402, and the third sub-pattern 403 in the listed sequence. Thereafter, the embroidery data is rearranged in order to sew the outlines for the first sub-pattern 401, the second sub-pattern 402, and the third sub-pattern 403 in the listed sequence as illustrated in FIG. 3. The sewing sequence may be edited by the user through the edit screen 104.

When the refresh key 64 is touched in the enlarge screen 103 (step S16: YES), the controller 21 re-executes the assigning process at step S5. As a result, new stitch patterns randomly extracted for the outlines and surface regions for each of the sub-patterns are displayed instead of the embroidery pattern being currently displayed. When the return key 61 is further touched (step S15: YES), the process flow proceeds to step S3 in which the stitch pattern setting screen 102 is displayed. It is thus, possible to restart the process flow from category setting, etc.

As described above, the embroidery data generator 30 of the first embodiment is provided with a first pattern storing unit, a first pattern extracting unit, and a first pattern assigning unit. The first pattern storing unit is configured to store multiple types of first pattern data (surface region pattern data) configured for sewing a surface region, being delineated as an embroidery region, according to a predetermined stitch pattern. The first pattern extracting unit is configured to randomly extract the first pattern data from the plural types of first pattern data stored in the first pattern storing unit. The first pattern data is configured for sewing the surface region located in an inner side of an outline of a sub-pattern. The first pattern assigning unit is configured to assign the extracted first pattern data to each sub-pattern.

It is thus, possible to randomly determine the stitch pattern to be applied to each of the surface regions of the sub-patterns of an embroidery pattern by assigning the first pattern data extracted by the first pattern extracting unit to the sub-patterns. As a result, it is possible to generate embroidery data with ease while eliminating cumbersome tasks such as verification and specification of stitch patterns to be applied to the surface region of each sub-pattern. It is further possible to form embroidery patterns with unintended and unexpected impressions with ease by the rich variety of combinations of surface region stitch patterns available for each sub-pattern. The user is thus, allowed to readily obtain an embroidery pattern with the desired combination of stitch patterns.

The embroidery data generator 30 is further provided with a second pattern storing unit, a second pattern extracting unit, and a second pattern assigning unit corresponding to the first pattern storing unit, the first pattern extracting unit, and the first pattern assigning unit described above for processing a second pattern data (outline pattern data) configured for sewing outlines of sub-patterns according to a predetermined stitch pattern. It is thus, possible to randomly determine the stitch pattern to be applied to each of the outlines of the sub-patterns of an embroidery pattern by assigning the second pattern data extracted by the second pattern extracting unit to the sub-patterns. As a result, it is possible to generate embroidery data with ease while eliminating cumbersome tasks such as verification and specification of stitch patterns to be applied to the outline of each sub-pattern. It is further possible to form embroidery patterns with unintended and unexpected impressions with ease by the rich variety of combinations of outline stitch patterns available for each sub-pattern. The user is thus, allowed to readily obtain an embroidery pattern with the desired combination of outline stitch patterns.

The controller 21 serves as a first pattern assigning unit configured to assign different first pattern data to the adjacent sub-patterns. It is thus, possible to form embroidery data having clearly distinguishable surface regions by assigning different stitch patterns to the adjacent stitch patterns while randomly determining the stitch patterns.

The first pattern data and the second pattern data are each classified into multiple categories. The controller 21, as well as the display 9 and the touch panel 9*a*, serve as a first category specifying unit and a second category specifying unit. The controller 21 is configured to randomly extract first pattern data, configured for sewing the sub-patterns, from the first pattern data belonging to the category specified by the first category specifying unit. The controller 21 is also configured to randomly extract second pattern data, configured for sewing the sub-patterns, from the second pattern data belonging to the category specified by the second category specifying unit.

The first category specifying unit allows the user to select the desired category of the surface region stitch pattern. The second category specifying unit allows the user to select the desired category of the outline stitch pattern. Thus, while the controller 21 is configured to randomly determine the stitch patterns to be applied to the surface region stitch pattern and the outline stitch pattern, it is possible to easily form embroidery data by using stitch patterns belonging to the category suited to the user's preference and senses.

The first edit unit is configured to edit parameter(s) for determining the size and/or the shape of the surface region stitch pattern. The second edit unit is configured to edit parameter(s) for determining the size and/or the shape of the outline stitch pattern. Thus, while the controller 21 is configured to randomly determine the stitch patterns to be applied to the surface region stitch pattern and the outline stitch pattern, it is possible to edit the sizes and/or the shapes of the surface region stitch pattern and the outline stitch pattern of the embroidery pattern to suit the user's preference and senses by using the first edit unit and the second edit unit.

The controller 21 serves as a display control unit. The display control unit is configured to display an embroidery pattern to the display unit by applying a stitch pattern, designed to sew the surface region of a sub-pattern, based on the first pattern data. The display control unit is further configured to display an embroidery pattern to the display unit by applying a stitch pattern, designed to sew the outline of a sub-pattern, based on the second pattern data. The user is thus, allowed to readily visualize the surface region stitch patterns and the outline stitch patterns of sub-patterns formed defined in the embroidery data.

Second Embodiment

Figure 16:
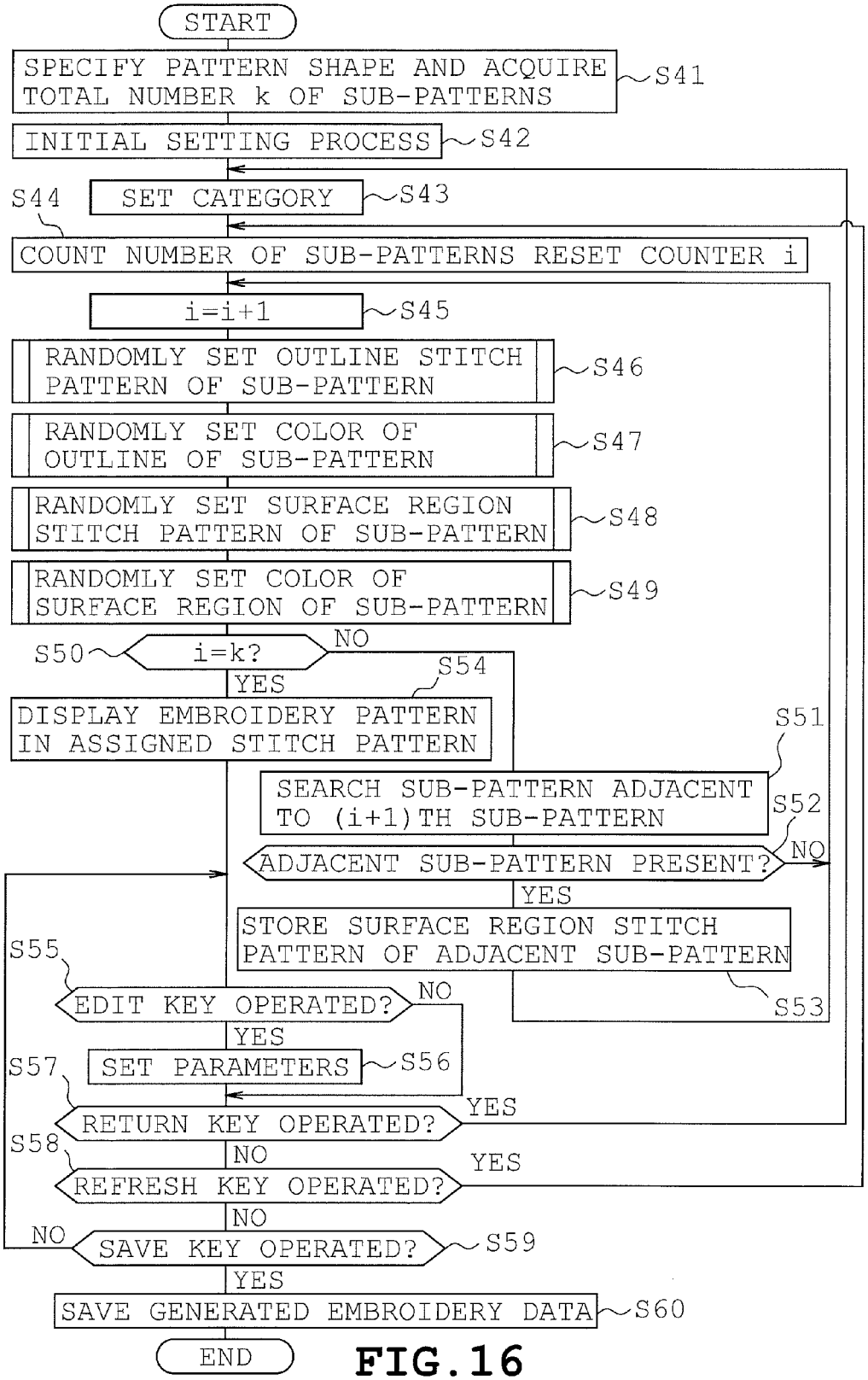
FIG. 16 pertains to a second embodiment and corresponds to FIG. 13.
Figure 17:
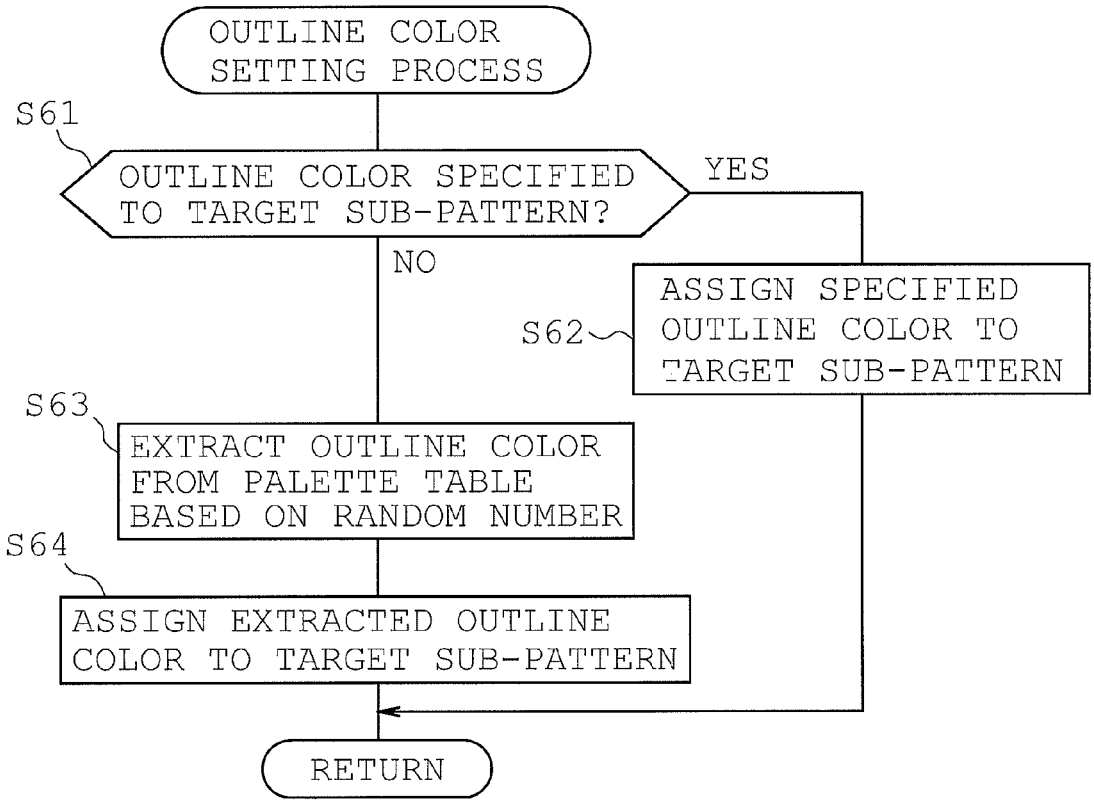
FIG. 17 is a flowchart of an outline color setting process.
Figure 18:
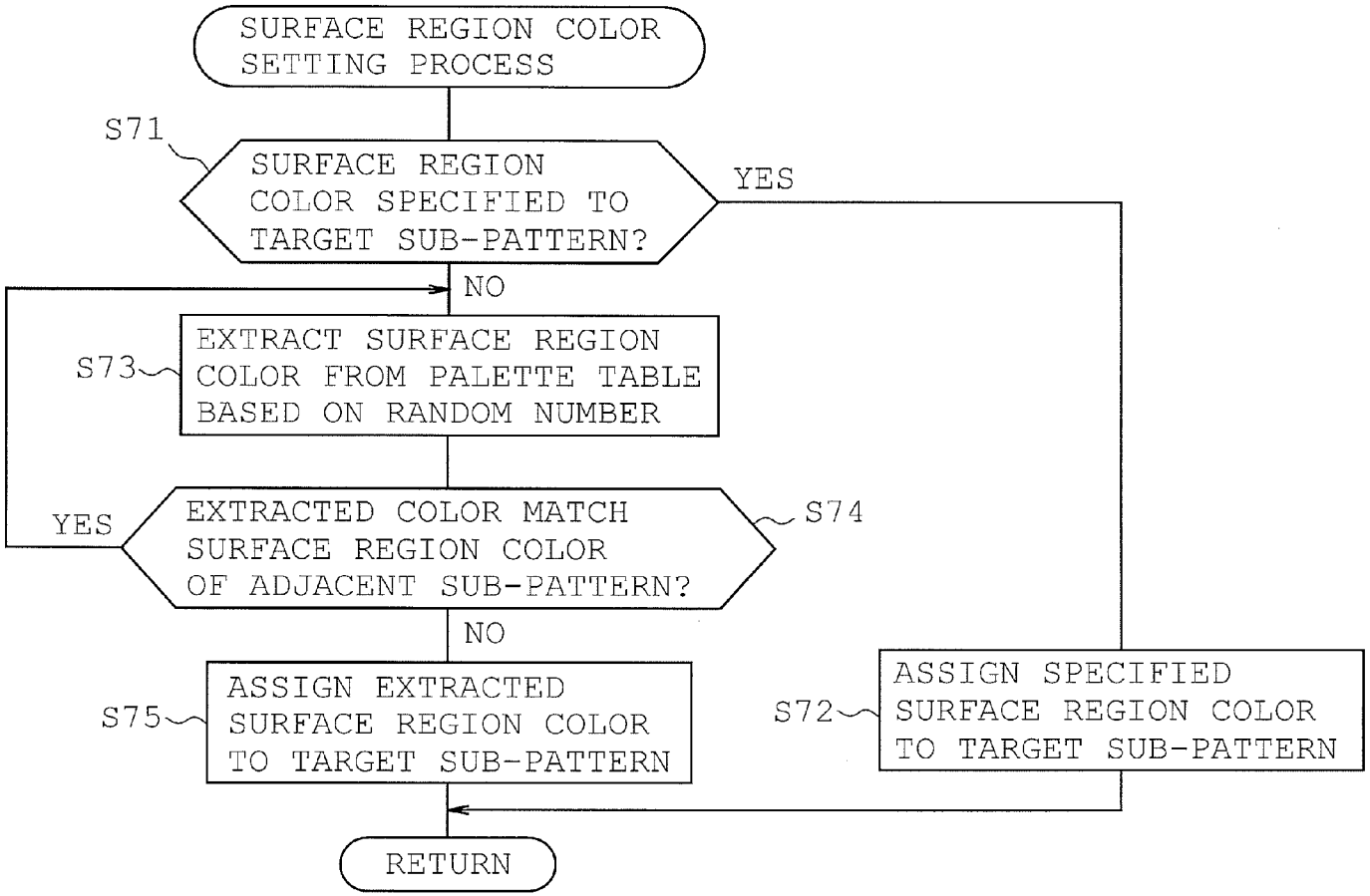
FIG. 18 is a flow chart of a surface region color setting process.

FIGS. 16 to 18 illustrate a second embodiment of the present disclosure. A description will be given hereinafter on the differences from the first embodiment. As described above, the colors of the sub-patterns in the first embodiment are determined by assigning the thread color data preset to the embroidery pattern selected at step S1 or by assigning the thread color data specified by the user at step S2. In contrast, the colors of the sub-patterns in the second embodiment are assigned by randomly extracting the color to be used as thread color data from the color information contained in the palette table.

The flowchart indicated in FIG. 16 is substantially identical to the flowchart indicated in FIG. 13 except for the color setting process of sub-patterns being added. More specifically, steps S41 to S46, S48, and S50 to S60 of FIG. 16 correspond to steps S1 to S18 of the flowchart indicated in FIG. 13. Steps S47 and S49 representing the processes for setting the colors of sub-patterns are added to the flowchart indicated in FIG. 16.

First, when the user wishes to change the color of the surface region or the outline of a sub-pattern of an embroidery pattern selected at step S41, the user is to touch the thread spool 52*a* provided in the thread color setting area 52 representing the intended color. Then, the user is to specify the desired color from the first color palette 53 or the second color palette (step S42). Then in the stitch pattern setting screen 102 invoked by transition from the first color edit screen 101 or from the second color edit screen, a category is set by touching either of the keys 57 and 58*a* to 58*f* (step S43). Then, the controller 21 resets the counter i to 0 (zero) and thereafter increments the counter i by 1 (step S44, S45). The controller 21 proceeds to execute the processes for setting the outline stitch patterns and surface region stitch patterns (steps S46 and S48) starting from the first sub-pattern, while also executing processes for randomly setting the colors of outlines and surface regions (step S47 and S49).

More specifically, the controller 21 randomly sets the outline stitch pattern of the first sub-pattern at step S46 and thereafter proceeds to step S47 to randomly set the color of the outline of the first sub-pattern. At this instance, the controller 21 determines whether or not a color to be applied to the outline of the first sub-pattern has been specified by the user at step S42 as indicated in FIG. 17 (step S61). If a color to be applied to the outline of the first sub-pattern has been specified by the user, the specified color is applied to the outline of the first sub-pattern (step S62).

If the user has not specified a color, on the other hand (step S61: NO), the controller 21 sets the first color palette 53 as the palette to be used in coloring the stitch pattern when having determined for example that the screen transition has been made to the stitch pattern setting screen 102 from the first color edit screen 101. The controller 21 refers the first palette table and generates a random number within the range of the palette-based color number which spans from 1 to 64 in this example (step S63). The maximum number of the palette-wise color number, which is 64 in this example, is equivalent to the total number of colors available. Further, the controller 21 searches the palette-based color numbers ranging from 1 to 64 within the first palette table and extracts the color (RGB value) of the palette-based color number that matches the generated random number. The controller 21 stores the extracted color in the second color information storage area 247 of the RAM 24 (step S64) as the thread color data to be assigned to the outline of the first sub-pattern. The process flow is thereafter returned to step S48 indicated in FIG. 16.

Then, the controller 21 randomly sets the surface region stitch pattern to be applied to the first sub-pattern at step S48. The controller 21 thereafter proceeds to step S49 and randomly sets the color of the surface region of the first sub-pattern. At this instance, the controller 21 determines whether or not a color to be applied to the surface region of the first sub-pattern has been specified by the user at step S42 as indicated in FIG. 18 (step S71). If a color to be applied to the surface region of the first sub-pattern has been specified by the user, the specified color is applied to the surface region of the first sub-pattern (step S72).

If the user has not specified a color, on the other hand (step S71: NO), the controller 21 sets the first color palette 53 as the palette to be used in coloring the stitch pattern for example and generates a random number within the range of the available palette-based color number spanning from 1 to 64 (step S73). Then, the controller 21 searches the palette-based color numbers ranging from 1 to 64 within the first palette table and extracts the color of the palette-based color number that matches the generated random number. At step S74, a determination is made as to whether or not the color randomly extracted for the surface region is identical to the colors of other adjacent surface regions. Because colors are not assigned to any other surface regions at this point in time (step S74: NO), the determination step will be later described in detail. Further, the controller 21 stores the extracted color in the first color information storage area 246 of the RAM 24 (step S75) as the thread color data to be assigned to the surface region of the first sub-pattern. The process flow is thereafter returned to step S50 indicated in FIG. 16.

After generating embroidery data for the first sub-pattern (step S50: NO) by the above described process, the controller 21 searches for the presence of sub-pattern(s) adjacent to a second sub-pattern (i+1th sub-pattern) which is generated next in sequence (step S51). The controller 21, when having determined that there are no adjacent sub-patterns (step S52: NO), returns the process flow back to step S5. In contrast, when having determined the presence of sub-pattern(s) adjacent to the second sub-pattern (step S52: YES), the controller 21 stores the color(s) of the surface region(s) of the adjacent sub-pattern(s) along with the pattern number(s) of the surface region stitch pattern(s) of the adjacent sub-pattern(s) to the adjacent data storage area 249 (step S53) and returns the process flow back to step S5. In the example of embroidery pattern 40, both the first sub-pattern 401 and the third sub-pattern 403 are disposed adjacent to the second sub-pattern 402. However, since only the stitch pattern and the color of the first sub-pattern 401 are identified at this point in time, the controller 21 stores only the pattern number and the color of the first sub-pattern 401 to the adjacent data storage area 249.

The controller 21 thereafter increments the counter i of the sub-pattern by 1 (i=i+1) in step S45. The controller 21 executes the stitch pattern setting process for the second sub-pattern in order to assign the randomly extracted outline stitch pattern and color to the second sub-pattern (step S46, S47).

As was the case in the first embodiment, a stitch pattern different from the stitch pattern of the first sub-pattern is randomly extracted and assigned to the surface region of the second sub-pattern (step S48). Further, a color different from the color of the surface region of the first sub-pattern is randomly extracted and assigned to the surface region of the second sub-pattern (step S49). More specifically, suppose that the user has not specified a color to be applied to the surface region F2 of the second sub-pattern (step S71: NO). In such case, the controller 21 extracts a color corresponding to a palette-based color number that matches the random number generated in the manner described earlier (step S73). Then, the controller 21 determines whether or not the extracted color matches the color stored in the adjacent data storage area 249 (step S74). When having determined that the color of the former matches the color of the latter (step S74: YES), step S73 is repeated to extract a new color. Thus, the controller 21 extracts a color different from the surface area of the first sub-pattern 401 and stores the extracted color in the first color information storage area 246 as the thread color data of the surface region of the second sub-pattern 402 (step S75).

After generating the embroidery data for the second sub-pattern by the above described process, the controller 21 searches for the presence of sub-pattern(s) adjacent to a third sub-pattern which is generated next in sequence (step S50: NO, step S51). When having determined the presence of sub-pattern(s) adjacent to the third sub-pattern, the controller 21 stores the color(s) of the surface region(s) of the adjacent sub-pattern(s) along with the pattern number(s) of the surface region stitch pattern(s) of the adjacent sub-pattern(s) to the adjacent data storage area 249 (step S52: YES, step S53). The controller 21 is thus, configured to assign a stitch pattern and a color to the outline as well as to the surface region (steps S46 to steps S49) of the third sub-pattern (step S45) as well. The embroidery data for the third sub-pattern is generated in the above described manner. The controller 21, when having determined that the value of counter i is equal to the number k of the sub-patterns (step S50: YES), proceeds to step S54.

The controller 21 displays the embroidery pattern to the enlarge screen 103 in the colors randomly assigned to each of the stitch patterns of the sub-patterns (step S54). In the displayed embroidery pattern, the surface regions of the adjacently disposed sub-patterns are colored differently (note the difference in the surface regions indicated by reference symbols F1, F2, and F3 in FIG. 11).

Further, processes similar to those carried out in steps S15 to S18 indicated in FIG. 13 are carried out in steps S57 to S60. Thus, when the refresh key 64 is touched in the enlarge screen 103 (step S58: YES), the controller 21 randomly extracts and assigns new stitch patterns and colors to the outlines and the surface regions of each sub-pattern. The controller 21 is further configured to store the generated embroidery data to the EEPROM 25 (step S60, END) by touching the save key 62 (step S59: YES).

As described above, the controller 21 of the second embodiment serves as a first color extracting unit and a first color assigning unit. The first color extracting unit is configured to randomly extract thread colors used for sewing the surface regions of sub-patterns from color information stored in the first color storing unit. The first pattern assigning unit is configured to assign the extracted color to each sub-pattern. It is thus, possible to randomly apply colors to the threads for sewing the surface regions of sub-patterns of an embroidery pattern. As a result, it is possible to determine the coloring of the embroidery pattern with ease while eliminating cumbersome tasks such as verification and specification of color information to be applied to the thread for sewing the surface region of each sub-pattern.

The controller 21 of the second embodiment further serves as a second color extracting unit and a second color assigning unit. The second color extracting unit is configured to randomly extract thread colors used for sewing the outlines of sub-patterns from color information stored in the second color storing unit. The second pattern assigning unit is configured to assign the extracted color to each sub-pattern. As a result, is also possible to randomly apply colors to the threads for sewing the outlines of sub-patterns as well and obtain rich variety of coloring patterns.

The controller 21 is configured to assign different colors to the adjacent sub-patterns. It is thus, possible to form embroidery data having clearly distinguishable sub-patterns by assigning different colors to the surface regions of adjacent sub-patterns while randomly determining the colors to be applied to the surface regions of sub-patterns.

Third Embodiment

Figure 19B:
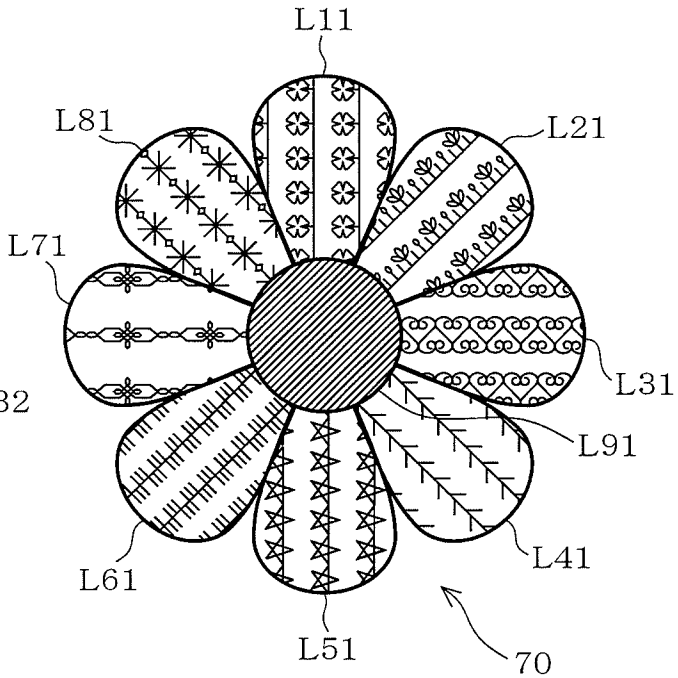
FIGS. 19A and 19B pertains to a third embodiment and illustrate one example of an embroidery pattern.
Figure 19A:
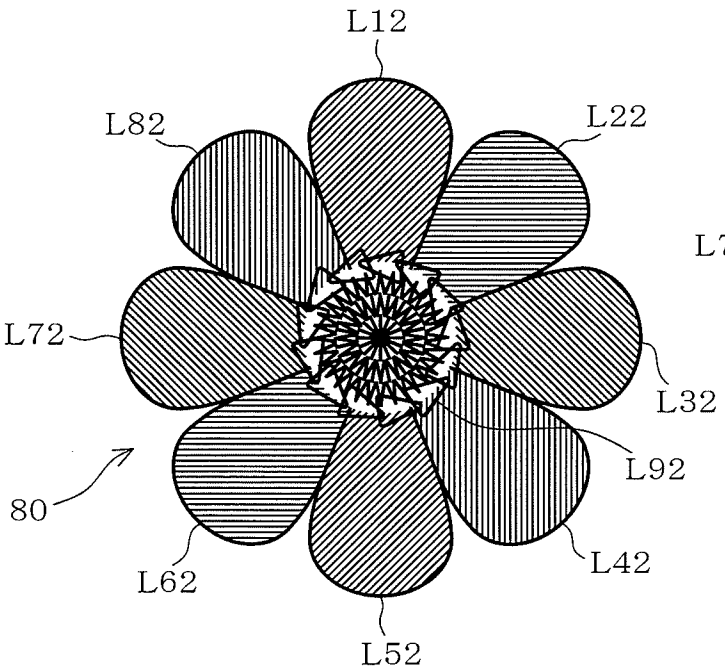

FIG. 19A illustrates a third embodiment of the present disclosure. A description will be given hereinafter on the differences from the second embodiment. In the second embodiment, the embroidery data generated for the embroidery pattern 70 representing a "flower" in FIG. 19B applies different stitch patterns and colors to each of the surface regions within the outlines L21 to L91 of first to ninth sub-patterns. It is assumed that a running stitch is specified at step S42 for each of the stitch patterns applied to outlines L21 to L91 of the embroidery pattern 70.

In contrast, the third embodiment arranges the adjacent sub-patterns to be identical in shape or to be of the same type of shape as is the case for an embroidery pattern 80 representing a "flower" illustrated in FIG. 19A. More specifically, the controller 21 generates embroidery data in which the stitch patterns and the colors of the adjacent sub-patterns are consistent.

For example, the controller 21 randomly sets stitch patterns and colors to the outline L12 and the surface region of the first sub-pattern (steps S46 to S49 described earlier). Then, at step S53, the controller 21 stores the stitch patterns and the colors applied to the outline L12 and the surface region in the adjacent data storage area 249 as data permitted to be assigned to sub-patterns of the second and later sub-patterns.

Next, the controller 21 sets stitch patterns to the outlines of the second and later sub-patterns (step S46). At this instance, the controller 21 determines whether or not the outline of the current sub-pattern is identical in shape to the outlines of the adjacent sub-patterns (i.e. whether the adjacent sub-patterns are congruent) based on the coordinate data of each of the outlines L12 to L92 prior to executing step S23 indicated in FIG. 14. In case the adjacent sub-patterns are shaped differently, the controller 21 assigns randomly extracted patterns (step S23, S24). In case the adjacent sub-patterns are shaped identically, the controller 21 executes a process to assign a stitch pattern stored in the adjacent data storage area 249 instead of steps S23 and S24.

The controller 21 further sets colors to the outlines of the second and later sub-patterns (step S47). At this instance, the controller 21 determines whether or not the current sub-pattern is identical in shape to the adjacent sub-patterns based on the coordinate data of each of the outlines L12 to L92 prior to executing step S63 indicated in FIG. 17. In case the adjacent sub-patterns are shaped differently, the controller 21 assigns randomly extracted colors (step S63, S64). In case the adjacent sub-patterns are shaped identically, the controller 21 executes a process to assign a color stored in the adjacent data storage area 249 instead of steps S63 and S64.

Similarly, when setting stitch patterns and colors to the surface regions of the second and later sub-patterns (step S48, S49), a determination is made as to whether or not the adjacent sub-patterns are shaped identically. In case the adjacent sub-patterns are shaped differently, the controller 21 assigns randomly extracted patterns and colors to the surface regions of the second and later sub-patterns (steps S33 and S35 of FIG. 15, steps S73 and S75 of FIG. 18). In case the adjacent sub-patterns are shaped identically, on the other hand, the controller 21 executes a process to assign stitch pattern and colors stored in the adjacent data storage area 249 to the surface regions of the second and later sub-patterns. Thus, step S34 indicated in FIG. 15 and step S74 indicated in FIG. 18 are omitted in the third embodiment.

In the embroidery data of the embroidery pattern 80 generated by the above described process flow, the same stitch pattern and color is set to the outlines L12 to L82 of first to eighth sub-patterns representing petals of a flower as illustrated in FIG. 19A while also being capable of randomly determining the stitch patterns and colors to the sub-patterns. The surface regions within the outlines L12 to L82 are also set to the same stitch pattern and color. In an alternative embodiment, the same stitch pattern and color may be assigned to the sub-patterns even if they are not disposed adjacently as long as they are identically shaped.

Embodiments described above may be modified or expanded as follows.

In the embodiments described above, the embroidery data generator is provided with the first pattern extracting unit and the first pattern assigning unit configured for processing the surface regions of sub-patterns and the second pattern extracting unit and the second pattern assigning unit configured for processing the outlines of sub-patterns. Alternatively, the embroidery data generator may be configured to be provided with at least either set of extracting unit and assigning unit.

The types and the number of stitch patterns to be stored (registered) to the surface pattern table and the line pattern table may be modified as required. The types and the number of categories are not limited to the examples of "basic" to "snow" described above but may be modified as required.

In the above described embodiments, the embroidery data generator is provided in the sewing machine M. However, the embroidery data generator may be provided in the form of a so-called personal computer (or a dedicated machine) typically configured by a main body, a mouse, a keyboard, a memory card connector, a display, etc.

In case the sewing machine M and the embroidery data generator are configured separately unlike the embodiments described above, the sewing machine M and the embroidery data generator may exchange data through wire or wireless communication.

In the above described embodiments, the ROM 23, the RAM 24, and the EEPROM 25 are used as examples of the pattern storing unit and the color storing unit. Alternatively, other internal storages provided in the sewing machine or the embroidery data generator, or external storages removably attached to the sewing machine or the embroidery data generator may be used instead.

The computer readable storing medium that stores the embroidery data generator program is not limited to the ROM 23 but may be configured by a CD-ROM, a flexible disk, a DVD, a memory card, or the like. In such case, the computer readable storing medium is read and executed through a computer of the dedicated machine, etc. mentioned above to provide operation and effects similar to those of the above described embodiments.

In the embodiments described above, a single CPU may perform all of the processes. Nevertheless, the disclosure may not be limited to the specific embodiment thereof, and a plurality of CPUs, a special application specific integrated circuit ("ASIC"), or a combination of a CPU and an ASIC may be used to perform the processes.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

We claim:

1. An embroidery data generator configured to generate embroidery data comprising:

a pattern storing unit configured to store plural types of pattern data configured for sewing one or more sub-patterns according to a predetermined stitch pattern, the one or more sub-patterns constituting an embroidery pattern, each of the plural types of pattern data including data indicating a unique pattern of stitch lines different from other types of pattern data; and a control device configured to:

randomly extract pattern data containing data indicating unique patterns of stitch lines configured for sewing the one or more sub-patterns from the plural types of pattern data stored in the pattern storing unit, and assign extracted pattern data to the one or more sub-patterns.

2. The embroidery data generator according to claim 1, wherein the plural types of pattern data include plural types of surface region pattern data configured for sewing a surface region defined as an embroidery region according to a predetermined stitch pattern, and wherein the control device is configured to randomly extract pattern data, configured for sewing an inner side of an outline of the one or more sub-patterns as the surface region, from the plural types of surface region pattern data.

3. The embroidery data generator according to claim 2, wherein when the embroidery pattern is formed of two or more sub-patterns, the control device is further configured to assign different surface region pattern data to adjacent sub-patterns.

4. The embroidery data generator according to claim 1, wherein the plural types of pattern data include plural types of outline pattern data configured for sewing an outline of the one or more sub-patterns according to a predetermined stitch pattern, and wherein the control device is further configured to randomly extract pattern data for sewing the outline of the one or more sub-patterns from the plural types of outline pattern data.

5. The embroidery data generator according to claim 1, further comprising a category specifying unit configured to specify one of plural categories, wherein the plural types of pattern data stored in the pattern storing unit is classified into plural categories, and wherein the control device is further configured to randomly extract pattern data for sewing the one or more sub-patterns from pattern data belonging to a category selected by the category specifying unit.

6. The embroidery data generator according to claim 1, further comprising an edit unit configured to edit parameters for modifying size and/or shape of the predetermined stitch pattern.

7. The embroidery data generator according to claim 1, further comprising a color storing unit configured to store multiple entries of predefined color information, wherein the control device is further configured to:

randomly extract a color of thread, used for sewing the one or more sub-patterns based on the plural types of pattern data, from color information stored in the color storing unit, and assign randomly extracted color to each of the one or more sub-patterns.

8. The embroidery data generator according to claim 7, wherein the plural types of pattern data include plural types of surface region pattern data configured for sewing a surface region, defined as an embroidery region, according to a predetermined stitch pattern, and wherein the control device is further configured to:

randomly extract a color of thread, used for sewing a surface region of the one or more sub-patterns based on the plural types of surface region pattern data, from color information stored in the color storing unit, and assign different colors to adjacent sub-patterns.

9. The embroidery data generator according to claim 1, further comprising a display unit configured to display information pertaining to a sewing operation, wherein the control device is further configured to display the embroidery pattern with the stitch pattern defined in extracted pattern data.

10. A non-transitory computer readable storing medium storing computer readable instructions that, when executed by a control device of an embroidery data generator provided with a pattern storing unit configured to store plural types of pattern data configured for sewing an embroidery pattern formed of one or more sub-patterns according to a predetermined stitch pattern, cause the control device to:

randomly extract pattern data configured for sewing the one or more sub-patterns from the plural types pattern data stored in the pattern storing unit, each of the plural types of pattern data including data indicating a unique pattern of stitch lines different from other types of pattern data, and assign extracted pattern data to the one or more sub-patterns.

11. The medium according to claim 10, wherein the plural types of pattern data include plural types of surface region pattern data configured for sewing a surface region defined as an embroidery region according to a predetermined stitch pattern, wherein the instructions further cause the control device to randomly extract pattern data configured for sewing an inner side of an outline of the one or more sub-patterns as the surface region from the plural types of surface region pattern data.

12. The medium according to claim 11, wherein the instructions further cause the control device to assign different surface region pattern data to adjacent sub-patterns.

13. The medium according to claim 10, wherein the plural types of pattern data include plural types of outline pattern data configured for sewing an outline of the one or more sub-patterns according to a predetermined stitch pattern, and wherein the instructions further cause the control device to randomly extract pattern data configured for sewing the outline of the one or more sub-patterns from the plural types of outline pattern data.

14. The medium according to claim 10, wherein the embroidery data generator further comprises a category specifying unit configured to specify one of plural categories, wherein the plural types of pattern data stored in the pattern storing unit is classified into plural categories, and wherein the instructions further cause the control device to randomly extract pattern data for sewing the one or more sub-patterns from pattern data belonging to a category selected by the category specifying unit.

15. The medium according to claim 10, wherein the instructions further cause the control device to edit parameters for modifying a size and/or a shape of the predetermined stitch pattern upon receiving an input operation.

16. The medium according to claim 10, wherein the embroidery data generator further comprises a color storing unit configured to store multiple entries of predefined color information, wherein the instructions further cause the control device to:

randomly extract a color of thread, used for sewing the one or more sub-patterns based on the plural types of pattern data, from color information stored in the color storing unit, and assign randomly extracted color to each of the one or more sub-patterns.

17. The medium according to claim 16, wherein the plural types of pattern data include plural types of surface region pattern data configured for sewing a surface region defined as an embroidery region according to a predetermined stitch pattern, and wherein the instructions further cause the control device to:

randomly extract a color of thread, used for sewing a surface region of the one or more sub-patterns based on the plural types of surface region pattern data, from color information stored in the color storing unit, and assign different colors to adjacent sub-patterns.

18. The medium according to claim 10, wherein the embroidery data generator further comprises a display unit configured to display information pertaining to a sewing operation, wherein the instructions further cause the control device to display the embroidery pattern in the stitch pattern defined in extracted pattern data.

19. A sewing machine comprising:

a sewing unit configured to be capable of sewing a workpiece based on embroidery data;

a pattern storing unit configured to store plural types of pattern data configured for sewing one or more sub-patterns according to a predetermined stitch pattern, the one or more sub-patterns constituting an embroidery pattern, each of the plural types of pattern data including data indicating a unique pattern of stitch lines different from other types of pattern data; and a control device configured to:

randomly extract pattern data, configured for sewing the one or more sub-patterns, from the plural types of pattern data including data indicating unique patterns of stitch lines stored in the pattern storing unit, assign extracted pattern data to the one or more sub-patterns, and control the sewing unit to sew an embroidery pattern on the workpiece, the embroidery pattern formed of the one or more sub-patterns having been assigned the pattern data.

* * * * *